US011645958B2

(12) United States Patent
Park et al.

(10) Patent No.: US 11,645,958 B2
(45) Date of Patent: May 9, 2023

(54) DISPLAY DEVICE

(71) Applicant: LG Display Co., Ltd., Seoul (KR)

(72) Inventors: Dongwon Park, Goyang-si (KR); YongChul Kwon, Seoul (KR); JungJae Kim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/542,019

(22) Filed: Dec. 3, 2021

(65) Prior Publication Data

US 2022/0208043 A1 Jun. 30, 2022

(30) Foreign Application Priority Data

Dec. 30, 2020 (KR) ..... 10-2020-0187223
Sep. 3, 2021 (KR) ..... 10-2021-0117765

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2300/0443* (2013.01); *G09G 2310/0291* (2013.01); *G09G 2330/028* (2013.01)

(58) Field of Classification Search
CPC ..... G09G 3/006; G09G 3/20; G09G 2300/0443; G09G 2310/0291; G09G 2330/028
See application file for complete search history.

(56) References Cited

U.S. PATENT DOCUMENTS

2016/0086561 A1* 3/2016 Kim ..... G09G 3/3696 345/92

FOREIGN PATENT DOCUMENTS

KR 10-0681040 B1 2/2007

* cited by examiner

*Primary Examiner* — Gerald Johnson
(74) *Attorney, Agent, or Firm* — Birch, Stewart, Kolasch & Birch, LLP

(57) ABSTRACT

A display device can include a display panel including a plurality of subpixels; a feedback part; and a power source configured to output a first power voltage to the feedback part and the display panel, in which the feedback part is configured to output a virtual feedback voltage to the power source, the virtual feedback voltage being based on the first power, and the power source is further configured to adjust a magnitude of the first power voltage to generate an adjusted first power voltage based on the virtual feedback voltage.

23 Claims, 22 Drawing Sheets

DISPLAY DEVICE

CROSS-REFERENCE TO RELATED APPLICATIONS

This application claims priority to Korean Patent Application No. 10-2020-0187223 filed on Dec. 30, 2020 in the Republic of Korea, and Korean Patent Application No. 10-2021-0117765 filed on Sep. 3, 2021 in the Republic of Korea, the entirety of all these applications are incorporated herein by reference into the present application.

BACKGROUND

Field

The present disclosure relates to a display device, and more particularly, to a display device which performs feedback using a virtual feedback voltage.

Description of the Related Art

Recently, as society enters the full-fledged information era, a display field which visually expresses electrical information signals has been rapidly developed, and in response to this, various display devices having excellent performances, such as thin-thickness, light weight, and low power consumption, have been developed. Specific examples of the display device may include a liquid crystal display (LCD) device and an organic light emitting display (OLED) device.

The organic light emitting display device is a self-emitting display device (e.g., a separate backlight source is not necessary), which is different from the liquid crystal display device. Therefore, the organic light emitting display device may be manufactured to have light weight and small thickness. Further, since the organic light emitting display device is driven at a low voltage, it is advantageous not only in terms of power consumption, but also in terms of the color implementation, the response speed, the viewing angle, and the contrast ratio (CR). As a result, the light emitting display device is being studied as next generation displays.

SUMMARY OF THE DISCLOSURE

An object to be achieved by the present disclosure is to provide a display device which improves luminance imbalance and color variation caused by the voltage drop in a display panel.

Another object to be achieved by the present disclosure is to provide a display device which performs a virtual feedback on a high potential power voltage, rather than an actual feedback on a high potential power voltage in a display panel.

Still another object to be achieved by the present disclosure is to provide a display device which performs a feedback on a high potential power voltage at a relatively low cost.

Still another object to be achieved by the present disclosure is to provide a display device which is capable of minimizing delay of a compensation timing for a high potential power voltage.

Still another object to be achieved by the present disclosure is to provide a display device which is capable of performing a feedback on a high potential power voltage in consideration of a voltage drop due to a resistance between a power source and a display panel.

Objects of the present disclosure are not limited to the above-mentioned objects, and other objects, which are not mentioned above, can be clearly understood by those skilled in the art from the following descriptions.

According to an aspect of the present disclosure, a display device can include a display panel in which a plurality of sub pixels is disposed; a power source which outputs a high potential power voltage to the display panel; and a feedback part which receives the high potential power voltage output from the power source to output a virtual feedback voltage to the power source, in which the power source changes a magnitude of the high potential power voltage in accordance with a magnitude of the virtual feedback voltage to output the high potential power voltage.

Other detailed matters of example embodiments are included in the detailed description and the drawings.

According to the present disclosure, the luminance imbalance and the color variation generated in different locations of the display panel may be improved.

According to the present disclosure, a feedback on a high potential power voltage may be provided only with an output signal of a power source without measuring high potential power voltages in all locations of a display panel.

According to the present disclosure, a cost associated with providing feedback on the high potential power voltage may be saved.

According to the present disclosure, a delay of a compensation timing for the high potential power voltage may be minimized.

According to the present disclosure, the voltage drop due to a resistance between the power source and the display panel may be compensated.

The effects according to the present disclosure are not limited to the contents exemplified above, and more various effects are included in the present disclosure.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
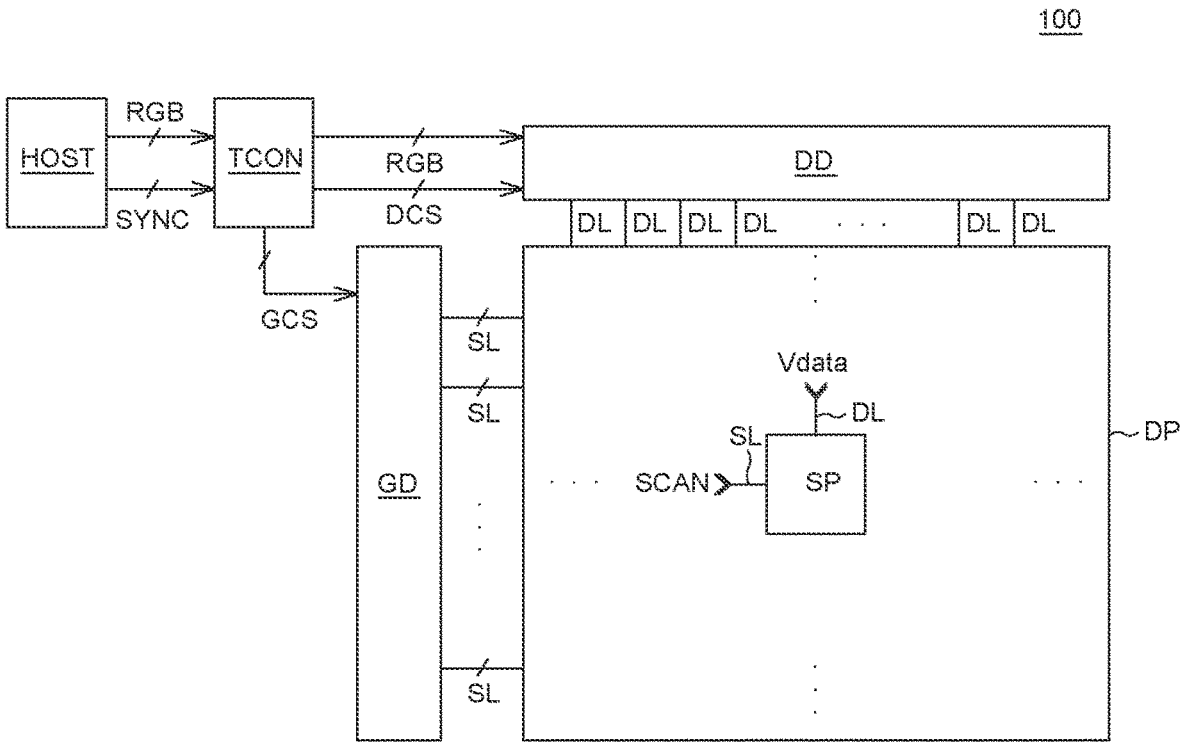
FIG. 1 is a schematic block diagram of a display device according to an embodiment of the present disclosure.

Advantages and characteristics of the present disclosure and a method of achieving the advantages and characteristics will be clear by referring to example embodiments described below in detail together with the accompanying drawings. However, the present invention is not limited to the example embodiments disclosed herein but will be implemented in various forms. The example embodiments are provided by way of example only so that a person of ordinary skilled in the art can fully understand the disclosures of the present invention and the scope of the present invention. Therefore, the present invention will be defined only by the scope of the appended claims.

The shapes, sizes, ratios, angles, numbers, and the like illustrated in the accompanying drawings for describing the example embodiments of the present disclosure are merely examples, and the present disclosure is not limited thereto. Like reference numerals generally denote like elements throughout the specification. Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only." Any references to singular may include plural unless expressly stated otherwise.

Components are interpreted to include an ordinary error range even if not expressly stated.

When the position relation between two parts is described using the terms such as "on," "above," "over," "below," and "next," one or more parts may be positioned between the two parts unless the terms are used with the term "immediately" or "directly."

When an element or layer is disposed "on" another element or layer, another layer or another element may be interposed directly on the other element or therebetween.

Although the terms "first," "second," and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

A size and a thickness of each component illustrated in the drawing are illustrated for convenience of description, and the present disclosure is not limited to the size and the thickness of the component illustrated.

The features of various embodiments of the present disclosure can be partially or entirely bonded to or combined with each other and can be interlocked and operated in technically various ways, and the embodiments can be carried out independently of or in association with each other.

Hereinafter, the present disclosure will be described in detail with reference to the drawings.

FIG. 1 is a schematic block diagram of a display device according to an embodiment of the present disclosure. All the components of each display device according to all embodiments of the present disclosure are operatively coupled and configured.

In FIG. 1, for the convenience of description, among various components of a display device 100, a display panel DP, a gate driver GD, a data driver DD, a timing controller TCON, and a host system HOST are illustrated.

Referring to FIG. 1, the display device 100 includes a display panel DP including a plurality of sub pixels SP, a gate driver GD and a data driver DD which supply various signals to the display panel DP, and a timing controller TCON which controls the gate driver GD and the data driver DD.

The gate driver GD supplies a plurality of scan signals SCAN to a plurality of scan lines SL in accordance with a plurality of gate control signals GCS supplied from the timing controller TCON. Even though in FIG. 1, it is illustrated that one gate driver GD is spaced apart from one side of the display panel DP, the gate driver GD can be disposed in a gate in panel (GIP) manner and the number of gate drivers GD and the placement thereof are not limited thereto.

The data driver DD converts image data RGB input from the timing controller TCON into a data signal Vdata using a reference gamma voltage in accordance with a plurality of data control signals DCS supplied from the timing controller TCON. The data driver DD can supply the converted data signal Vdata to the plurality of data lines DL.

The timing controller TCON aligns image data RGB input from the host system HOST to supply the aligned image data to the data driver DD. The timing controller TCON can generate a gate control signal GCS and a data control signal DCS using synchronization signals SYNC input from the host system HOST, such as a dot clock signal, a data enable signal, and horizontal/vertical synchronization signals. The timing controller TCON supplies the generated gate control signal GCS and data control signal DCS to the gate driver GD and the data driver DD, respectively, to control the gate driver GD and the data driver DD.

The host system HOST includes a system on chip SoC embedded with a scaler and converts digital video data of the input image into image data RGB having a format suitable to be displayed on the display panel DP to output the converted image data RGB. The host system HOST supplies synchronization signals SYNC, such as a dot clock signal, a data enable signal, and a horizontal/vertical signal, to the timing controller TCON, together with the image data RGB.

The display panel DP is a configuration which displays images to the user and includes the plurality of sub pixels SP. In the display panel DP, the plurality of scan lines SL and the plurality of data lines DL intersect each other and the plurality of sub pixels SP are connected to the scan lines SL and the data lines DL, respectively. Also, the plurality of sub pixels SP can be connected to a high potential power line, a low potential power line, an initialization signal line, an emission control signal line, and the like.

Each of the plurality of sub pixels SP is a minimum unit which configures a screen and each of the plurality of sub pixels SP can include a light emitting diode and a pixel circuit for driving the light emitting diode. The plurality of light emitting diodes can be defined in different ways depending on a type of the display panel DP. For example, when the display panel DP is an organic light emitting display panel, the light emitting diode can be an organic light emitting diode which includes an anode, an organic layer, and a cathode. In addition to this, as the light emitting diode, a quantum-dot light emitting diode (QLED) including quantum dots (QD), an inorganic light emitting diode (LED), and the like can be further used. Hereinafter, even though the description will be made under the assumption that the light emitting diode is the organic light emitting diode, the type of the light emitting diode is not limited thereto.

The pixel circuit is a circuit for controlling the driving of the light emitting diode. For example, the pixel circuit can be configured to include a plurality of transistors and one or more capacitors, but is not limited thereto.

Figure 2:
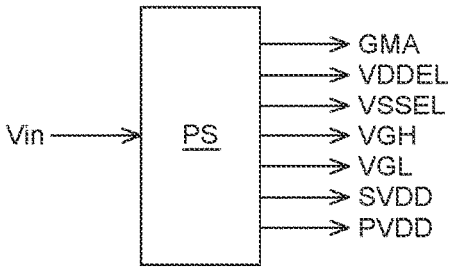
FIG. 2 is a schematic block diagram of a power source of a display device according to an embodiment of the present disclosure.

FIG. 2 is a schematic block diagram of a power source of a display device according to an embodiment of the present disclosure.

Referring to FIG. 2, the power source PS generates a power required to drive the display panel DP, the data driver DD, and the gate driver GD, using a DC-DC converter. The DC-DC converter can include a charge pump, a regulator, a buck converter, and a boost converter. The power source PS can be implemented by a power management integrated circuit (PMIC).

The power source PS generates a power required to drive the display panel DP, the data driver DD, and the gate driver GD, by regulating a DC input voltage Vin from the host system HOST. The power source PS can generate power, such as a gamma reference voltage GMA, a gate high voltage VGH, a high potential power voltage VDDEL, a low potential power voltage VSSEL, a gamma power voltage PVDD, and a buffer driving voltage SVDD. The gamma reference voltage GMA is supplied to the data driver DD. The gate-off voltage VGH and the gate-on voltage VGL are supplied to the gate driver GD. The gamma power voltage PVDD is supplied to a gamma voltage generator of the power source PS. The buffer driving voltage SVDD is supplied to an output buffer of the data driver DD. However, some of the above-described various powers which are supplied by the power source PS can be omitted depending on the design of the display panel DP, the data driver DD, and the gate driver GD. Further, the power source PS can supply other types of power different than the above-described various powers to the display panel DP, the data driver DD, and the gate driver GD.

Hereinafter, a virtual feedback operation on the high potential power voltage VDDEL in the display device 100 according to the embodiment of the present disclosure will be described in more detail with reference to FIG. 3 together.

Figure 3:
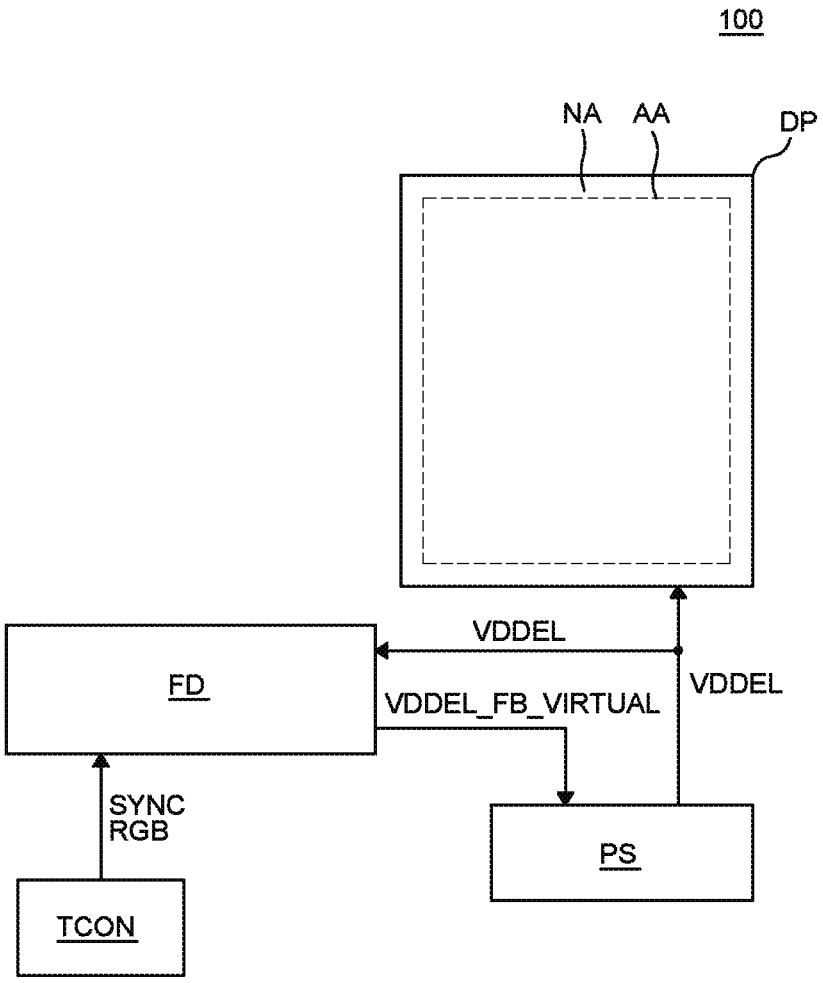
FIGS. 3 and 4 are schematic block diagrams of a display device according to an embodiment of the present disclosure.

FIG. 3 is a schematic block diagram of a display device according to an embodiment of the present disclosure. In FIG. 3, for the convenience of description, among various components of the display device 100, only the display panelDP, the power source PS, the timing controller TCON, and the feedback part FD (e.g., a feedback circuit, a feedback controller, a feedback unit) are illustrated.

Referring to FIG. 3, the power source PS supplies the high potential power voltage VDDEL to the display panel DP. The high potential power voltage VDDEL output from the power source PS can be transmitted to each sub pixel SP of the display panel DP by a printed circuit board, a flexible film such as a chip on film COF, and a wiring line.

The timing controller TCON supplies the synchronization signal SYNC and image data RGB to the feedback part FD. Here, the synchronization signal SYNC can be a signal such as a horizontal/vertical synchronization signal SYNC and the image data RGB can be the same image data RGB as image data RGB which is transmitted to the data driver DD, but are not limited thereto.

The feedback part FD receives the high potential power voltage VDDEL output from the power source PS to output a virtual feedback voltage VDDEL_FB_VIRTUAL to the power source PS. The feedback part FD can directly receive the high potential power voltage VDDEL output from the power source PS in real time. That is, the feedback part FD can receive a high potential power voltage VDDEL output from the power source PS in which no voltage drop occurs, rather than a high potential power voltage VDDEL measured in the display panel DP in which the voltage drop occurs. The feedback part FD can generate a virtual feedback voltage VDDEL_FB_VIRTUAL based on the synchronization signal SYNC, the image data RGB supplied from the timing controller TCON and/or the high potential power voltage VDDEL received from the power source PS and output the generated virtual feedback voltage VDDEL_FB_VIRTUAL to the power source PS again.

At this time, the power source PS can change a magnitude of the high potential power voltage VDDEL in accordance with a magnitude of the virtual feedback voltage VDDEL_FB_VIRTUAL to output the high potential power voltage VDDEL.

A specific feedback process of the feedback part FD and the power source PS will be described in more detail with reference to FIG. 4 together.

Figure 4:
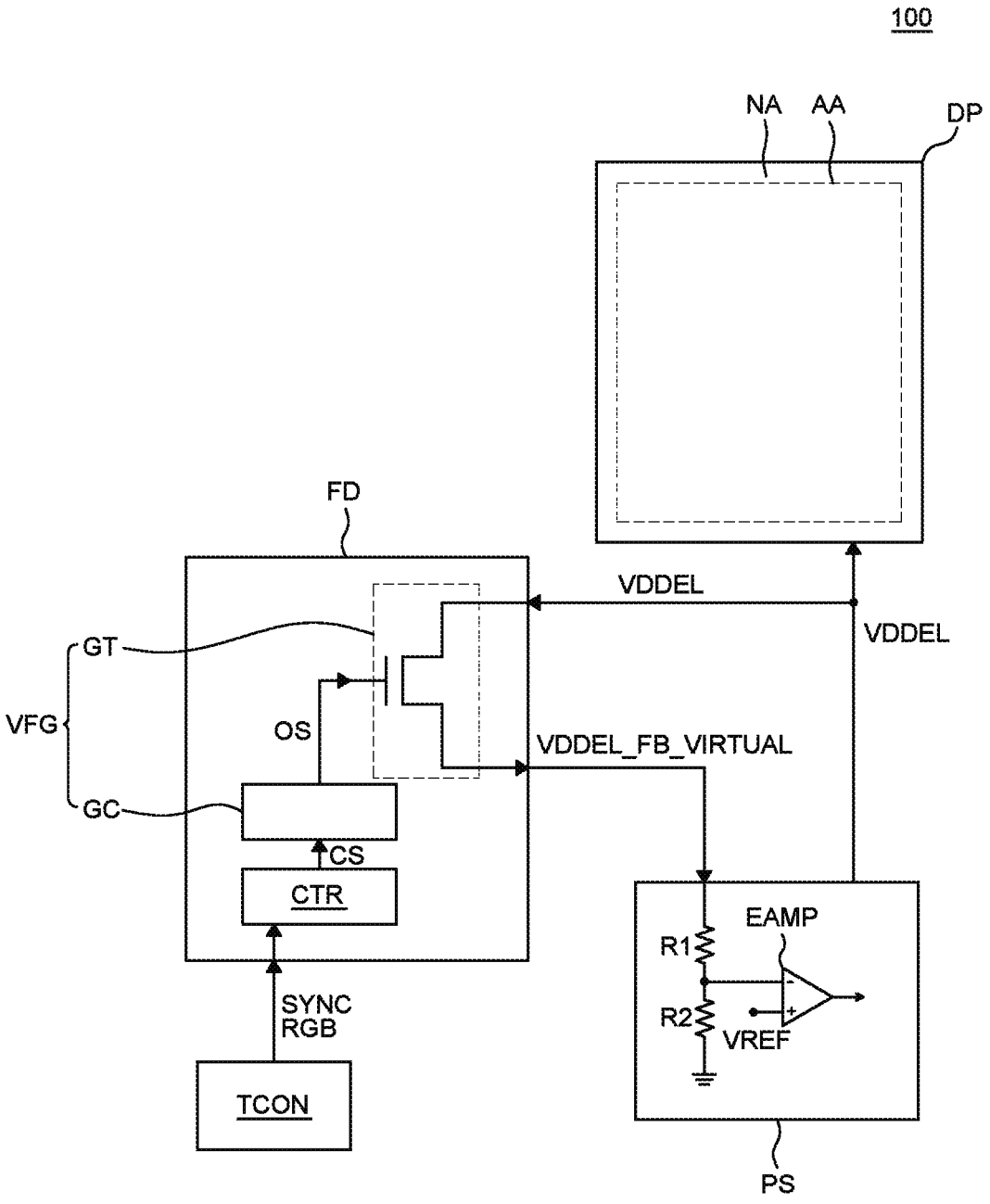
Figure 5:
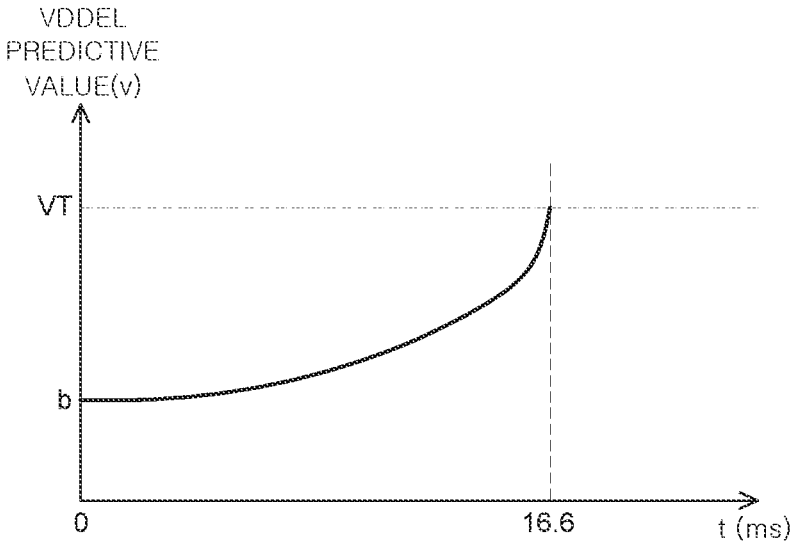
FIG. 5 is a graph for explaining an operation of a controller of a feedback part of a display device according to an embodiment of the present disclosure.

FIG. 4 is a schematic block diagram of a display device according to an embodiment of the present disclosure. FIG. 5 is a graph for explaining an operation of a controller of a feedback part (e.g., feedback circuit, feedback controller) of a display device according to an embodiment of the present disclosure.

Referring to FIG. 4, the feedback part FD includes a controller CTR and a virtual feedback voltage generator VFG.

The controller CTR generates a control signal CS based on the synchronization signal SYNC and the image data RGB from the timing controller TCON. Further, the controller CTR outputs the generated control signal CS to the virtual feedback voltage generator VFG.

A general equation of the high potential power voltage VDDEL to which voltage drop is reflected in accordance with a location in the display panel DP is represented as follows.

$$\mathrm{VDDEL}(n)=\mathrm{VDEL}_{IN}-(N*I_{total}-\Sigma_{n=1}^{N=1}(N-n)*In)*R \quad \text{[Equation 1]}$$

Equation 1 represents a high potential power voltage VDDEL which is applied to an n-th sub pixel SP in a vertical line of the display panel DP. In Equation 1, n denotes an n-th sub pixel SP located in a vertical line, $\mathrm{VDDEL}_{IN}$ denotes a high potential power voltage VDDEL applied from the power source PS, N denotes a total number of vertical lines, and $I_{total}$ denotes a total current flowing in the vertical line. In denotes a current flowing through an n-th vertical line and R denotes a resistance of the high potential power line corresponding to one sub pixel SP located in a vertical line. Here, when n is 0, that is, n has a minimum value, it refers to a sub pixel which is farthest from an inlet, which is a location in which the high potential power voltage VDDEL is applied as the first timing in one frame, and with respect to FIG. 4, it refers to a sub pixel SP located at the top of the display panel DP. Further, when n has a maximum value, it refers to a sub pixel SP closest to the inlet as the last timing in one frame and with respect to FIG. 4, it refers to a sub pixel SP located at the bottom of the display panel DP. For example, the voltage drop associated with VDDEL for various subpixels at different locations and with different types of display images can be simulated with one or more equations.

Here, when an image displayed on the display panel DP has a solid pattern, that is, is a monochromatic image, Equation 1 can be approximated as represented in Equation 2.

$$\mathrm{VDDEL}(n)=\mathrm{VDDEL}_{IN}-I_{total}*R*N+I*R*(n^2-n)/2 \quad \text{[Equation 2]}$$

Even though in Equation 1, not only n, but also In is a variable, Equation 2 can be approximated to a quadratic function for n, with an explanatory power of $R^2>97$ for n. Here, $R^2$ is an explanatory power of a generalization model and has a value between 0 and 100. According to Equation 2, the high potential power voltage VDDEL is represented in the form of a quadratic function of n and when n is converted into a time concept, Equation 2 can be represented by Equation 3.

$$\mathrm{VDDEL}(t)=at^2+b \quad \text{[Equation 3]}$$

Here, a equals $(VT-b)/(0.0166)^2$, VT is a target voltage VT of the high potential power voltage VDDEL to be supplied to the sub pixel SP of the display panel DP, 0.0166 is a value corresponding to 16.6 ms which is a time for one frame with respect to 60 Hz.

A predictive value of the high potential power voltage VDDEL in accordance with a time (t) corresponding to Equation 3 is as illustrated in the graph of FIG. 5. Referring to FIG. 5, at a timing of 16.6 ms corresponding to a sub pixel SP closest to the inlet of the high potential power voltage VDDEL, the voltage drop is not actually caused so that a value of the high potential power voltage VDDEL is a target voltage VT. In contrast, at a timing of 0 ms corresponding to a sub pixel SP farthest from the inlet, the voltage drop is maximum so that a value of the high potential power voltage VDDEL can be b value corresponding to a y intercept in Equation 3.

The controller CTR can generate a control signal CS to control the virtual feedback voltage generator VFG based on the above-described Equations 1 to 3. At this time, the value b can be determined based on the synchronization signal SYNC and the image data RGB from the timing controller TCON which are transmitted to the controller CTR. For example, the Equations 1 to 3 for determining the virtual feedback can be based on a variable (e.g., b) that dynamically changes based on other factors (e.g., the type of image data RGB supplied, the signal SYNC, etc.).

However, the operation of generating the control signal CS of the controller CTR is illustrative, and the control signal CS can be generated by predicting a degree of voltage drop of the high potential power voltage VDDEL by another method.

The virtual feedback voltage generator VFG generates a virtual feedback voltage VDDEL_FB_VIRTUAL based on the control signal CS from the controller CTR. The virtual feedback voltage generator VFG transmits the generated virtual feedback voltage VDDEL_FB_VIRTUAL to the power source PS.

The virtual feedback voltage generator VFG includes a generator circuit GC and a generator GT.

The generator circuit GC generates an output signal OS based on the control signal CS from the controller CTR. At this time, the generator circuit GC can generate an output signal OS which linearly or non-linearly decreases or increases. When the generator circuit GC generates an output signal OS which linearly decreases or increases, the generator circuit GC can be a ramp generator circuit. Further, when the generator circuit GC generates an output signal OS which non-linearly decreases or increases, the generator circuit GC can be a wave generator circuit. At this time, as long as the output signal OS is linearly or non-linearly output, the generator circuit GC can be designed to have an various configurations and is not limited to a specific circuit.

The generator GT generates a virtual feedback voltage VDDEL_FB_VIRTUAL based on the output signal OS from the generator circuit GC and the high potential power voltage VDDEL.

The generator GT can include a transistor, and more particularly, include an N-MOS type transistor. The output signal OS from the generator circuit GC is applied to a gate electrode of the generator GT. The high potential power voltage VDDEL from the power source PS is applied to a drain electrode of the generator GT. A source electrode of the generator GT can output a virtual feedback voltage VDDEL_FB_VIRTUAL.

A transistor of the generator GT can operate as a source follower. Therefore, when the output signal OS from the generator circuit GC which is applied to the gate electrode increases, the generator GT outputs a high virtual feedback voltage VDDEL_FB_VIRTUAL to the source electrode and when the output signal OS from the generator circuit GC decreases, the generator GT outputs a low virtual feedback voltage VDDEL_FB_VIRTUAL to the source electrode. Further, when the high potential power voltage VDDEL from the power source PS which is applied to the drain electrode increases, the generator GT outputs a high virtual feedback voltage VDDEL_FB_VIRTUAL to the source electrode and when the high potential power voltage VDDEL from the power source PS which is applied to the drain electrode decreases, the generator GT outputs a low virtual feedback voltage VDDEL_FB_VIRTUAL to the source electrode.

The power source PS can change a magnitude of the high potential power voltage VDDEL in accordance with a magnitude of the virtual feedback voltage VDDEL_FB_VIRTUAL to output the high potential power voltage VDDEL. Specifically, the power source PS includes an error amplifier EAMP which amplifies a difference between the virtual feedback voltage VDDEL_FB_VIRTUAL and a reference voltage VREF. The error amplifier EAMP amplifies and outputs a difference voltage between a divided voltage value of the virtual feedback voltage VDDEL_FB_VIRTUAL by a first resistor R1 and a second resistor R2 and the reference voltage VREF. For example, the reference voltage VREF can be a target voltage VT, but is not limited thereto. Therefore, when a magnitude of the virtual feedback voltage VDDEL_FB_VIRTUAL is larger than a threshold value, the power source PS reduces the high potential power voltage VDDEL to output the reduced high potential power voltage. When the magnitude of the virtual feedback voltage VDDEL_FB_VIRTUAL is smaller than the threshold value, the power source PS increases the high potential power voltage VDDEL to output the increased high potential power voltage.

A specific feedback process of the feedback part FD and the power source PS will be described in more detail with reference to FIGS. 6 and 7 together.

Figure 6:
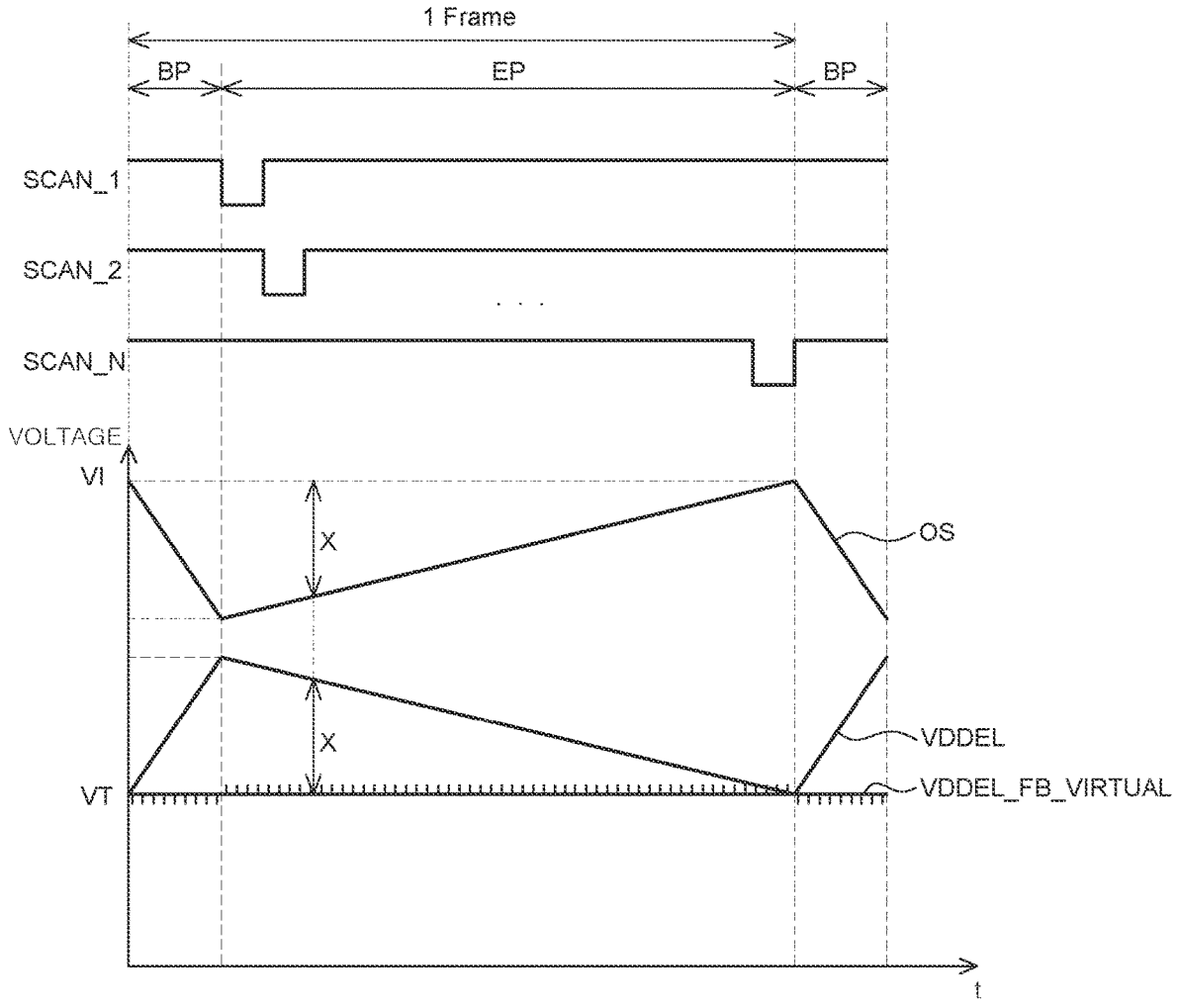
FIGS. 6 and 7 are timing diagrams for explaining a virtual feedback voltage generator of a feedback part of a display device according to an embodiment of the present disclosure.
Figure 7:
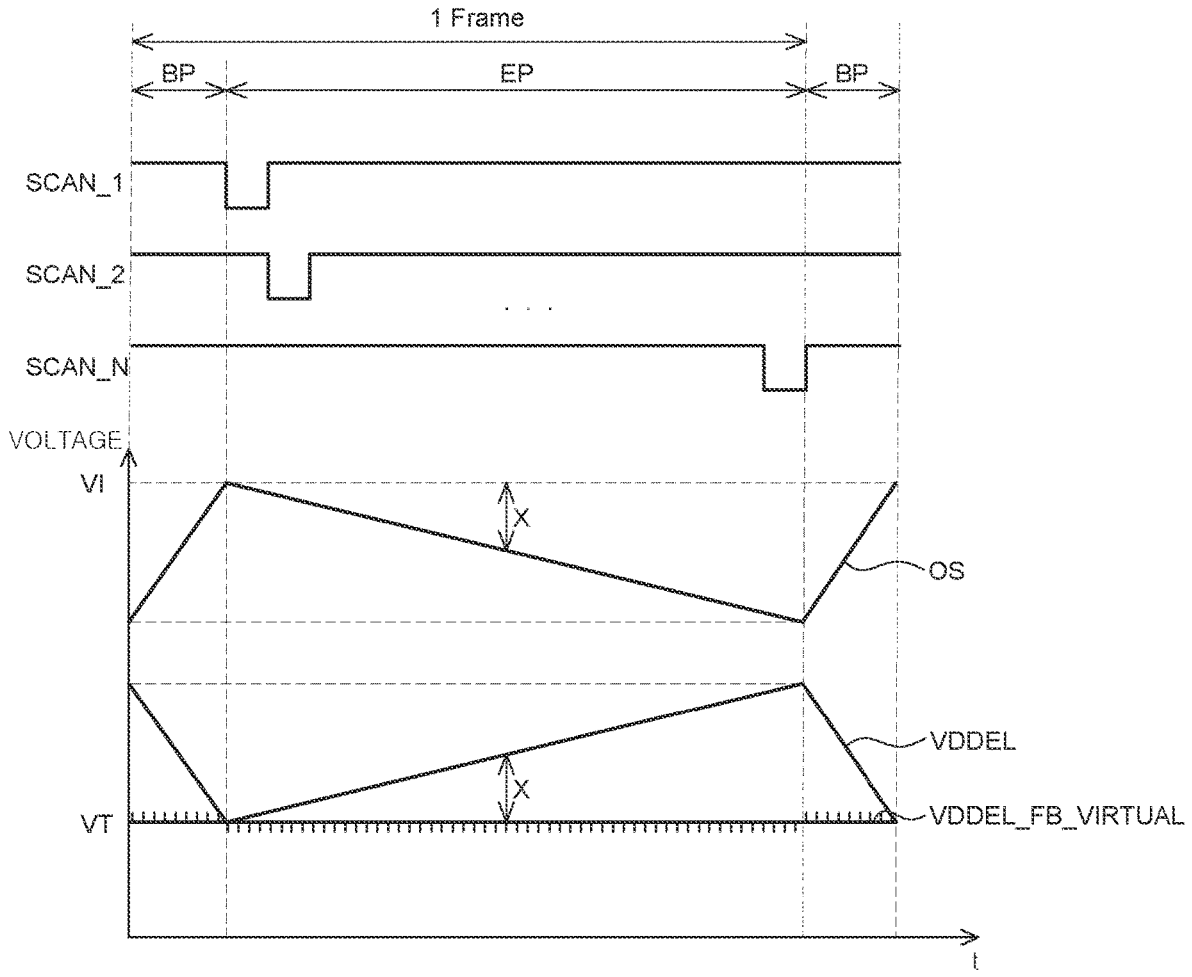

FIGS. 6 and 7 are timing diagrams for explaining a virtual feedback voltage generator of a feedback part of a display device according to an embodiment of the present disclosure. FIG. 6 is a timing diagram when a scan signal is applied first to the uppermost sub pixel SP which is the farthest from the inlet which is a location in the display panel DP illustrated in FIG. 4, in which the high potential power voltage VDDEL is applied. FIG. 7 is a timing diagram when a scan signal is applied first to the lowermost sub pixel SP which is the closest to the inlet which is a location in the display panel DP illustrated in FIG. 4, in which the high potential power voltage VDDEL is applied.

Referring to FIGS. 6 and 7, the plurality of sub pixels SP is driven in the unit of frames including a blank period BP and an emission period EP. The blank period BP can be a period in which a specific voltage in a plurality of sub pixels SP is sensed for the purpose of a compensation operation for the plurality of sub pixels SP and the emission period EP can be a period in which a plurality of sub pixels SP emits light.

First, referring to FIG. 6, the generator circuit GC can generate an output signal OS which decreases at an initial voltage VI during the blank period BP. In FIG. 6, the scan signal is applied first to the uppermost sub pixel SP which is a sub pixel SP farthest from the inlet which is a location in the display panel DP illustrated in FIG. 4 in which the high potential power voltage VDDEL is applied. Therefore, in order to apply the target voltage VT to a sub pixel SP which is applied with a first scan signal SCAN_1 to be turned on, the high potential power voltage VDDEL which is supplied by the power source PS needs to be higher than the target voltage VT. Therefore, the generator circuit GC can generate an output signal OS which decreases during the blank period BP.

The generator circuit GC generates an output signal OS which decreases during the blank period BP, so that the virtual feedback voltage VDDEL_FB_VIRTUAL which is generated by the generator GT can instantaneously decrease to be lower than the target voltage VT. Here, when the virtual feedback voltage VDDEL_FB_VIRTUAL instantaneously decreases, it means that the virtual feedback voltage VDDEL_FB_VIRTUAL decreases for a very short time, like an impulse signal.

Thereafter, the virtual feedback voltage VDDEL_FB_VIRTUAL instantaneously decreases. Therefore, the power source PS to which the virtual feedback voltage VDDEL_FB_VIRTUAL decreased to be lower than the target voltage VT is transmitted can increase the high potential power voltage VDDEL to be output from the power source PS to increase the virtual feedback voltage VDDEL_FB_VIRTUAL.

Thereafter, since the high potential power voltage VDDEL input to the generator GT is increased so that an input value input to the drain of the transistor of the generator GT is increased, the virtual feedback voltage VDDEL_FB_VIRTUAL output from the generator GT can also be increased. Accordingly, the virtual feedback voltage VDDEL_FB_VIRTUAL can be substantially maintained as a target voltage VT.

During the blank period BP, the above-described processes of decreasing the output signal OS, instantaneously decreasing the virtual feedback voltage VDDEL_FB_VIRTUAL in accordance with the decrease of the output signal OS, increasing the high potential power voltage VDDEL in the power source PS in accordance with the instantaneous decrease of the virtual feedback voltage VDDEL_FB_VIRTUAL, and increasing the virtual feedback voltage VDDEL_FB_VIRTUAL in accordance with the increase of the high potential power voltage VDDEL input to the generator GT are repeated. Accordingly, as illustrated in FIG. 6, during the blank period BP, the output signal OS decreases, the high potential power voltage VDDEL increases, and the virtual feedback voltage VDDEL_FB_VIRTUAL is substantially maintained as a target voltage VT, but the decreasing and increasing can be instantaneously repeated.

Referring to FIG. 6 again, the generator circuit GC can generate an output signal OS which increases during the emission period EP. In FIG. 6, the scan signal is applied first to the uppermost sub pixel SP which is farthest from the inlet which is a location in the display panel DP illustrated in FIG. 4 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the generator circuit GC can generate the output signal OS which increases during the emission period EP (e.g., the compensated high potential power voltage VDDEL and the output signal OS can be inversely related to each other).

The generator circuit GC generates an output signal OS which increases during the emission period EP, so that the virtual feedback voltage VDDEL_FB_VIRTUAL which is generated by the generator GT can instantaneously increase to be higher than the target voltage VT.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, since the high potential power voltage VDDEL input to the generator GT is decreased so that an input value input to the drain of the transistor of the generator GT is decreased, the virtual feedback voltage VDDEL_FB_VIRTUAL output from the generator GT can also be decreased. Accordingly, the virtual feedback voltage VDDEL_FB_VIRTUAL can be substantially maintained as a target voltage VT.

During the emission period EP, the above-described processes of increasing the output signal OS, instantaneously decreasing the virtual feedback voltage VDDEL_FB_VIRTUAL in accordance with the increase of the output signal OS, decreasing the high potential power voltage VDDEL in the power source PS in accordance with the instantaneous decrease of the virtual feedback voltage VDDEL_FB_VIRTUAL, and increasing the virtual feedback voltage VDDEL_FB_VIRTUAL in accordance with the decrease of the high potential power voltage VDDEL input to the generator GT are repeated. Accordingly, as illustrated in FIG. 6, during the emission period EP, the output signal OS increases, the high potential power voltage VDDEL decreases, and the virtual feedback voltage VDDEL_FB_VIRTUAL is substantially maintained as a target voltage VT, but the increasing and decreasing can be instantaneously repeated.

The high potential power voltage VDDEL output from the power source PS has a maximum value at the beginning of the emission period EP and can be a target voltage VT which is a minimum value at the end of the emission period EP. That is, an amount of a voltage X which is added to the target voltage VT from the virtual feedback voltage VDDEL_FB_VIRTUAL can be gradually decreased (e.g., since the farthest subpixel is powered first which would have experienced the largest voltage drop and needs the highest compensation for VDDEL, proceeding to the closest subpixel which experiences the least voltage drop and needs little to no compensation for VDDEL). At this time, the voltage X can correspond to a voltage drop amount actually generated in the display panel DP. For example, the voltage X added to the target voltage VT in the power source PS may be lost by a resistance of the wiring line during the process of being applied to the sub pixel SP along the wiring line in the display panel DP (e.g., in large, high resolution displays, the wiring lines can become rather long which can exaggerate the voltage drop, thus needing more compensation for VDDEL).

Referring to FIG. 7, the generator circuit GC can generate an output signal OS which increases at an initial voltage VI during the blank period BP. In FIG. 7, a scan signal is applied first to the lowermost sub pixel SP which is the closest to the inlet which is a location in the display panel DP illustrated in FIG. 4, in which the high potential power voltage VDDEL is applied, so that a location of the scan line SL to which the first scan signal SCAN_1 is applied is opposite. Accordingly, in order to apply the target voltage VT to the sub pixel SP which is applied with the first scan signal SCAN_1 to be turned on, the high potential power voltage VDDEL supplied by the power source PS needs to be the target voltage VT. Therefore, the generator circuit GC can generate an output signal OS which increases during the blank period BP. For example, in this situation, since the closest subpixel is powered first which would have experienced the least amount of voltage drop and needs little to no compensation for VDDEL, proceeding to the farthest subpixel which experiences the largest amount of voltage drop and needs most compensation for VDDEL.

The generator circuit GC generates an output signal OS which increases during the blank period BP, so that the virtual feedback voltage VDDEL_FB_VIRTUAL which is generated by the generator GT can instantaneously increase to be higher than the target voltage VT. Here, when the virtual feedback voltage VDDEL_FB_VIRTUAL instantaneously increases, it means that the virtual feedback voltage VDDEL_FB_VIRTUAL increases for a very short time, like an impulse signal (e.g., see the small discrete impulses in FIG. 7).

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, since the high potential power voltage VDDEL input to the generator GT is decreased so that an input value input to the drain of the transistor of the generator GT is decreased, the virtual feedback voltage VDDEL_FB_VIRTUAL output from the generator GT can also be decreased. Accordingly, the virtual feedback voltage VDDEL_FB_VIRTUAL can be substantially maintained as a target voltage VT.

During the blank period BP, the above-described processes of increasing the output signal OS, instantaneously increasing the virtual feedback voltage VDDEL_FB_VIRTUAL in accordance with the increase of the output signal OS, decreasing the high potential power voltage VDDEL in the power source PS in accordance with the instantaneous increase of the virtual feedback voltage VDDEL_FB_VIRTUAL, and decreasing the virtual feedback voltage VDDEL_FB_VIRTUAL in accordance with the decrease of the high potential power voltage VDDEL input to the generator GT are repeated. Accordingly, as illustrated in FIG. 7, during the blank period BP, the output signal OS increases, the high potential power voltage VDDEL decreases, and the virtual feedback voltage VDDEL_FB_VIRTUAL is substantially maintained as a target voltage VT, but the increasing and decreasing can be instantaneously repeated.

Referring to FIG. 7 again, the generator circuit GC can generate an output signal OS which decreases during the emission period EP. In FIG. 7, the scan signal is applied first to the lowermost sub pixel SP which is closest to the inlet which is a location in the display panel DP illustrated in FIG. 4 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually increased. Therefore, in order to gradually increase the high potential power voltage VDDEL which is applied from the power source PS during the emission period EP, the generator circuit GC can generate the output signal OS which decreases during the emission period EP (e.g., the output signal OS and the compensated high potential power voltage VDDEL can have an inverse relationship).

The generator circuit GC generates an output signal OS which decreases during the emission period EP, so that the virtual feedback voltage VDDEL_FB_VIRTUAL which is generated by the generator GT can instantaneously decrease to be lower than the target voltage VT.

Thereafter, the virtual feedback voltage VDDEL_FB_VIRTUAL instantaneously decreases. Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, the high potential power voltage VDDEL input to the generator GT is increased so that an input value input to the drain of the transistor of the generator GT is increased. Therefore, the virtual feedback voltage VDDEL_FB_VIRTUAL output from the generator GT can also be increased. Accordingly, the virtual feedback voltage VDDEL_FB_VIRTUAL can be substantially maintained as a target voltage VT.

During the emission period EP, the above-described processes of decreasing the output signal OS, instantaneously decreasing the virtual feedback voltage VDDEL_FB_VIRTUAL in accordance with the decrease of the output signal OS, increasing the high potential power voltage VDDEL in the power source PS in accordance with the instantaneous decrease of the virtual feedback voltage VDDEL_FB_VIRTUAL, and increasing the virtual feedback voltage VDDEL_FB_VIRTUAL in accordance with the increase of the high potential power voltage VDDEL input to the generator GT are repeated. Accordingly, as illustrated in FIG. 6, during the emission period EP, the output signal OS decreases, the high potential power voltage VDDEL increases, and the virtual feedback voltage VDDEL_FB_VIRTUAL is substantially maintained as a target voltage VT, but the decreasing and increasing can be instantaneously repeated.

A shown in FIG. 7, the high potential power voltage VDDEL output from the power source PS is a target voltage VT which is a minimum value at the beginning of the emission period EP and can have a maximum value at the end of the emission period EP (e.g., since in this example, the closest subpixel is powered first, and the subpixel farthest away is powered last). That is, an amount of a voltage X which is added to the target voltage VT from the virtual feedback voltage VDDEL_FB_VIRTUAL can be gradually increased. At this time, the voltage X can correspond to a voltage drop amount actually generated in the display panel DP.

For example, the voltage X added to the target voltage VT in the power source PS may be lost by a resistance of the wiring line during the process of being applied to the sub pixel SP along the wiring line in the display panel DP.

Referring to FIG. 4, the feedback part FD can be disposed to be separated from the timing controller TCON, the display panel DP, and the power source PS. However, it is not limited thereto and each of the controller CTR and the virtual feedback voltage generator VFG of the feedback part FD can be implemented to be integrated with one of the timing controller TCON, the display panel DP, and the power source PS. For example, the transistor of the generator GT of the virtual feedback voltage generator VFG can be disposed in the display panel DP.

In the display device 100, the voltage drop can occur due to a wiring resistance and a current of a high potential power line. Specifically, the longer the distance for which the sub pixel SP is located away from the inlet to which the power source PS is applied, the larger the voltage drop is, so that the high potential power voltage VDDEL is decreased and should be compensated. Without compensation of the high potential power voltage VDDEL, current variation due to the voltage drop depending on the position of the sub pixel SP occurs, which causes a luminance variation which can be noticeable to a viewer.

In addition, in order to compensate for a current variation due to the voltage drop caused for each sub pixel SP, the high potential power voltage VDDEL which is actually applied to the sub pixel SP can be fed-back to the power source SP. However, in order to feedback the high potential power voltage VDDEL which is actually applied to the sub pixel SP, many additional wiring lines and circuits need to be disposed on the display panel DP, which results in the increase of the cost and takes up more space. Further, the additional wiring lines and circuits need to be disposed not in the active area AA, but in the non-active area NA in the display panel DP, which results in the increase of an area of the non-active area NA.

The display device 100 can virtually perform the feedback on the high potential power voltage VDDEL without actual feedback on the high potential power voltage VDDEL in the display panel DP, thus avoiding the need for the additional wiring lines and additional circuits that would have been used to measure the actual/real feedback from the high potential power voltage VDDEL. Specifically, the feedback part FD can generate a virtual feedback voltage VDDEL_FB_VIRTUAL, which accurately simulated the actual/real feedback, by predicting a voltage drop which can be actually generated in the display panel DP, based on the high potential power voltage VDDEL output from the power source PS and the synchronization signal SYNC and the image data RGB from the timing controller TCON. Therefore, the power source PS changes a magnitude of the high potential power voltage VDDEL output from the power source PS in accordance with the magnitude of the virtual feedback voltage VDDEL_FB_VIRTUAL output from the feedback part FD to output the high potential power voltage. By doing this, the power source PS can apply a relatively higher high potential power voltage VDDEL to a sub pixel SP which is expected to have a larger amount of voltage drop, and the power source PS can apply a relatively lower high potential power voltage VDDEL to a sub pixel SP which is expected to have a smaller amount of voltage drop. Accordingly, the display device 100 according to an embodiment of the present disclosure can virtually perform the feedback on the high potential power voltage VDDEL and improve the luminance imbalance and the color variation due to the voltage drop, while using less wiring and fewer circuits, and saving space.

Figure 8:
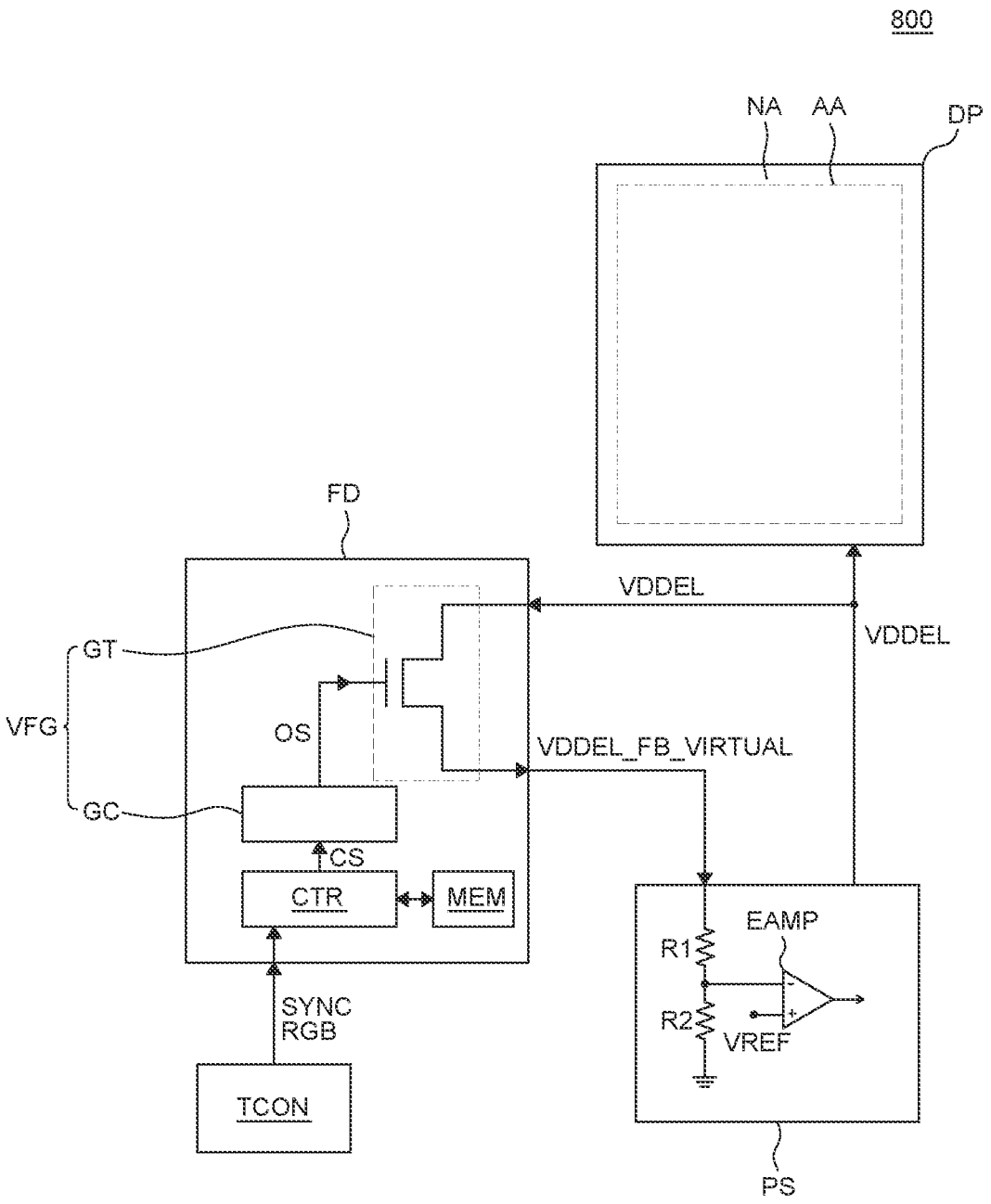
FIG. 8 is a schematic block diagram of a display device according to another embodiment of the present disclosure.

FIG. 8 is a schematic block diagram of a display device according to another embodiment of the present disclosure. A display device 800 of FIG. 8 further includes a memory MEM as compared with the display device 100 of FIGS. 1 to 7, but the configuration in FIG. 8 is substantially the same, so that redundant descriptions will be omitted or may be briefly provided.

Referring to FIG. 8, the feedback part FD can further include a memory MEM.

The memory MEM can store values which can control the control signal CS of the controller CTR, based on a voltage drop simulation result according to various image patterns or a measurement value. Such a memory MEM-stored value can be stored in the form of a look-up table (LUT). Therefore, the controller CTR calls a value from the look-up table (LUT) in the memory MEM that corresponds to the synchronization signal SYNC and the image data RGB, in order to generate a control signal CS.

The display device 800 according to another embodiment of the present disclosure can virtually perform the feedback on the high potential power voltage VDDEL without actual feedback on the high potential power voltage VDDEL in the display panel DP. Specifically, the feedback part FD can generate a virtual feedback voltage VDDEL_FB_VIRTUAL by predicting a voltage drop which can be actually generated in the display panel DP, based on the high potential power voltage VDDEL output from the power source PS and the synchronization signal SYNC and the image data RGB from the timing controller TCON. Therefore, the power source PS changes a magnitude of the high potential power voltage VDDEL output from the power source PS in accordance with the magnitude of the virtual feedback voltage VDDEL_FB_VIRTUAL output from the feedback part FD to output the high potential power voltage. By doing this, the power source PS can apply a relatively higher high potential power voltage VDDEL to a sub pixel SP which is expected to have a larger amount of voltage drop and apply a relatively lower high potential power voltage VDDEL to a sub pixel SP which is expected to have a smaller amount of voltage drop. Further, the controller CTR can easily and quickly generate a control signal CS using a value stored in the memory MEM which is included in the feedback part FD. Accordingly, the display device 800 according to another embodiment of the present disclosure can easily, quickly and virtually perform the feedback on the high potential power voltage VDDEL and improve the luminance imbalance and the color variation due to the voltage drop (e.g., the use of the look-up table LUT can be much faster than complicated calculations and equations).

Figure 9:
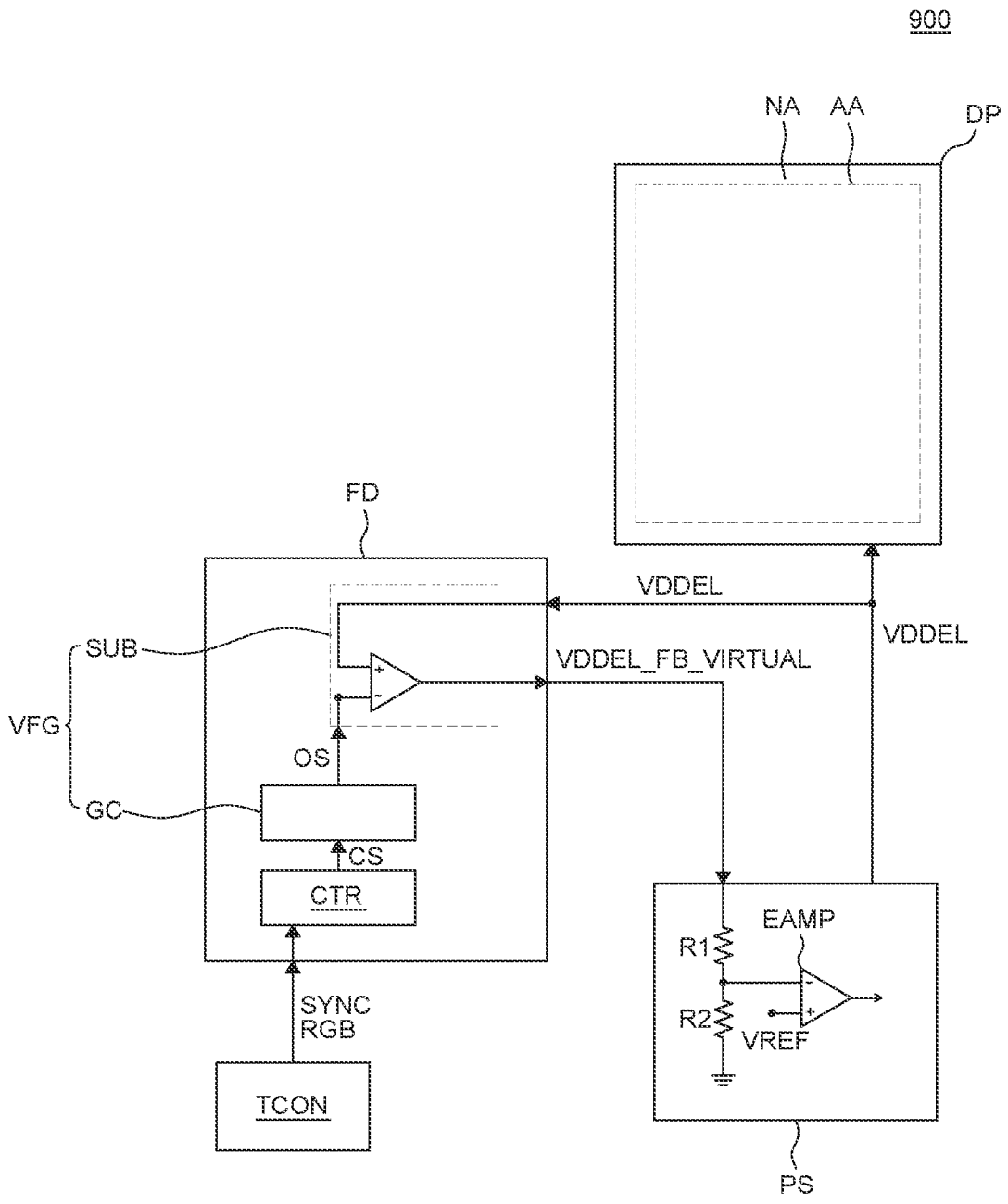
FIG. 9 is a schematic block diagram of a display device according to still another embodiment of the present disclosure.
Figure 10:
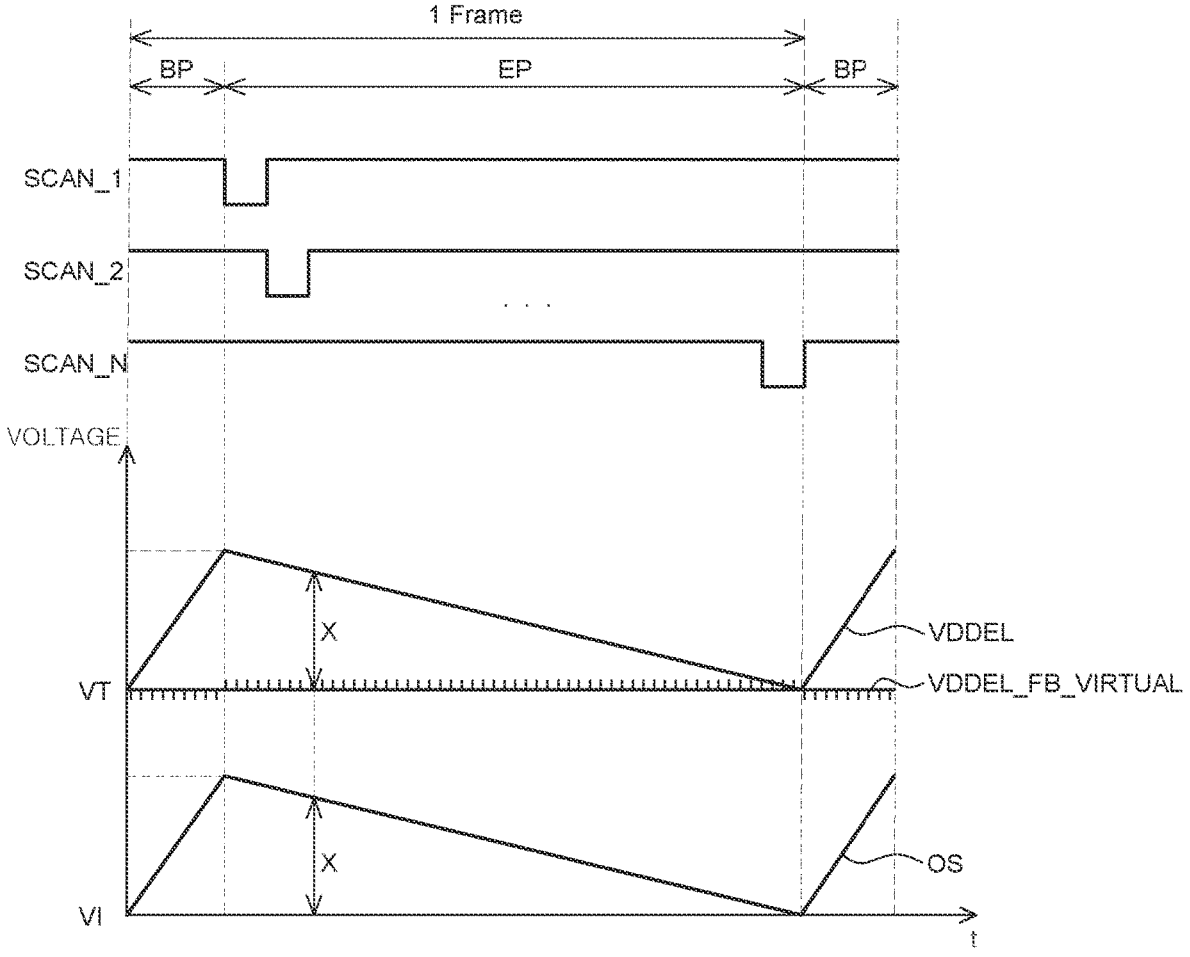
FIG. 10 is a timing diagram for explaining a virtual feedback voltage generator of a feedback part of a display device according to still another embodiment of the present disclosure.

FIG. 9 is a schematic block diagram of a display device according to still another embodiment of the present disclosure. FIG. 10 is a timing diagram for explaining a virtual feedback voltage generator of a feedback unit of a display device according to still another embodiment of the present disclosure. The only difference between a display device 900 of FIG. 9 and the display device 100 of FIGS. 1 to 7 is a virtual feedback voltage generator VFG used for providing the virtual feedback, but the other parts of the configuration are substantially the same, so that redundant descriptions will be omitted or may be briefly provided. FIG. 10 is a timing diagram when a scan signal is applied first to the uppermost sub pixel SP which is the farthest from the inlet which is a location in the display panel DP illustrated in FIG. 9, in which the high potential power voltage VDDEL is applied.

Referring to FIG. 9, the virtual feedback voltage generator VFG includes a generator circuit GC which generates an output signal OS linearly or non-linearly decreasing or increasing based on the control signal CS which is an output from the controller CTR and a generator which generates a virtual feedback voltage VDDEL_FB_VIRTUAL based on the output signal OS from the generator circuit GC and the high potential power voltage VDDEL.

Here, the generator can include a subtractor SUB which outputs a difference between the output signal OS and the high potential power voltage VDDEL as a virtual feedback voltage VDDEL_FB_VIRTUAL. The subtractor SUB can be an operational amplifier and generate a virtual feedback voltage VDDEL_FB_VIRTUAL using a difference of a high potential power voltage VDDEL which is applied to a positive (+) terminal and an output signal OS which is applied to a negative (−) terminal.

Referring to FIG. 10, the generator circuit GC can generate an output signal OS which increases at an initial voltage VI during the blank period BP. In FIG. 10, the scan signal is applied first to the uppermost sub pixel SP which is a sub pixel farthest from the inlet which is a location of the display panel DP illustrated in FIG. 9 in which the high potential power voltage VDDEL is applied. Therefore, in order to apply the target voltage VT to a sub pixel SP which is applied with a first scan signal SCAN_1 to be turned on, the high potential power voltage VDDEL which is supplied by the power source PS needs to be higher than the target voltage VT. Therefore, the generator circuit GC can generate an output signal OS which increases during the blank period BP (e.g., here, there can be a direct relationship or a positive correlation between output signal OS and the compensated high potential power voltage VDDEL, see FIG. 10).

The generator circuit GC generates the output signal OS which increases during the blank period BP so that the difference between the high potential power voltage VDDEL and the output signal OS is reduced. Therefore, the difference between the high potential power voltage VDDEL which is a virtual feedback voltage VDDEL_FB_VIRTUAL generated by the subtractor SUB and the output signal OS can be instantaneously reduced to be lower than the target voltage VT.

Thereafter, the virtual feedback voltage VDDEL_FB_VIRTUAL instantaneously decreases (e.g., discrete impulse values as shown in FIG. 10). Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, the high potential power voltage VDDEL input to the subtractor SUB is increased so that an input value which is input to a positive (+) terminal of the operational amplifier of the subtractor SUB is increased. Therefore, the difference between the high potential power voltage VDDEL and the output signal OS can be increased. By doing this, the virtual feedback voltage VDDEL_FB_VIRTUAL output from the subtractor SUB can also be increased. Accordingly, the virtual feedback voltage VDDEL_FB_VIRTUAL can be substantially maintained as a target voltage VT.

During the blank period BP, the above-described processes of increasing the output signal OS, instantaneously decreasing the virtual feedback voltage VDDEL_FB_VIRTUAL in accordance with the increase of the output signal OS, increasing the high potential power voltage VDDEL in the power source PS in accordance with the instantaneous decrease of the virtual feedback voltage VDDEL_FB_VIRTUAL, and decreasing the virtual feedback voltage VDDEL_FB_VIRTUAL in accordance with the increase of the high potential power voltage VDDEL input to the subtractor SUB are repeated. Accordingly, as illustrated in FIG. 10, during the blank period BP, the output signal OS increases, the high potential power voltage VDDEL increases, and the virtual feedback voltage VDDEL_FB_VIRTUAL is substantially maintained as a target voltage VT, but the decreasing and increasing can be instantaneously repeated.

Referring to FIG. 10 again, the generator circuit GC can generate an output signal OS which decreases during the emission period EP. In FIG. 10, the scan signal is applied first to the uppermost sub pixel SP which is farthest from the inlet which is a location in the display panel DP illustrated in FIG. 4 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the generator circuit GC can generate the output signal OS which decreases during the emission period EP.

The generator circuit GC generates the output signal OS which decreases during the emission period EP so that the difference between the high potential power voltage VDDEL and the output signal OS is increased. Therefore, the virtual feedback voltage VDDEL_FB_VIRTUAL generated by the subtractor SUB can be instantaneously increased to be higher than the target voltage VT.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, the high potential power voltage VDDEL input to the subtractor SUB is decreased so that an input value which is input to a positive (+) terminal of the operational amplifier of the subtractor SUB is decreased. Therefore, the difference between the high potential power voltage VDDEL and the output signal OS can be decreased. By doing this, the virtual feedback voltage VDDEL_FB_VIRTUAL output from the subtractor SUB can also be decreased. Accordingly, the virtual feedback voltage VDDEL_FB_VIRTUAL can be substantially maintained as a target voltage VT.

During the emission period EP, the above-described processes of decreasing the output signal OS, instantaneously increasing the virtual feedback voltage VDDEL_FB_VIRTUAL in accordance with the decrease of the output signal OS, decreasing the high potential power voltage VDDEL in the power source PS in accordance with the instantaneous increase of the virtual feedback voltage VDDEL_FB_VIRTUAL, and decreasing the virtual feedback voltage VDDEL_FB_VIRTUAL in accordance with the decrease of the high potential power voltage VDDEL input to the subtractor SUB are repeated. Accordingly, as illustrated in FIG. 10, during the emission period EP, the output signal OS decreases, the high potential power voltage VDDEL decreases, and the virtual feedback voltage VDDEL_FB_VIRTUAL is substantially maintained as a target voltage VT, but the increasing and decreasing can be instantaneously repeated.

The high potential power voltage VDDEL output from the power source PS has a maximum value at the beginning of the emission period EP and can be a target voltage VT which is a minimum value at the end of the emission period EP. That is, an amount of a voltage X which is added to the target voltage VT from the virtual feedback voltage VDDEL_FB_VIRTUAL can be gradually decreased. At this time, the voltage X can correspond to a voltage drop amount actually generated in the display panel DP. For example, the voltage X added to the target voltage VT in the power source PS may be lost by a resistance of the wiring line during the process of being applied to the sub pixel SP along the wiring line in the display panel DP.

In addition, even though the scan signal is applied first to the lowermost sub pixel SP which is a sub pixel SP closest to the inlet which is a location in which the high potential power voltage VDDEL is applied, the virtual feedback voltage VDDEL_FB_VIRTUAL can be supplied to the power source PS based on the description with reference to FIGS. 7 and 10 (e.g., the sub pixel located farthest away from the power inlet can be the first one powered, and the closest sub pixel can be the last one powered).

The display device 900 according to still another embodiment of the present disclosure can virtually perform the feedback on the high potential power voltage VDDEL without actual feedback on the high potential power voltage VDDEL in the display panel DP. Specifically, the feedback part FD can generate a virtual feedback voltage VDDEL_FB_VIRTUAL by predicting a voltage drop which can be actually generated in the display panel DP, based on the high potential power voltage VDDEL output from the power source PS and the synchronization signal SYNC and the image data RGB from the timing controller TCON (e.g., the actual/real voltage drop that is experienced in the display panel can be accurately simulated or estimated). Therefore, the power source PS changes a magnitude of the high potential power voltage VDDEL output from the power source PS in accordance with the magnitude of the virtual feedback voltage VDDEL_FB_VIRTUAL output from the feedback part FD to output the high potential power voltage. By doing this, the power source PS can apply a relatively higher high potential power voltage VDDEL to a sub pixel SP which is expected to have a larger amount of voltage drop and apply a relatively lower high potential power voltage VDDEL to a sub pixel SP which is expected to have a smaller amount of voltage drop. Accordingly, the display device 900 according to still another embodiment of the present disclosure can virtually perform the feedback on the high potential power voltage VDDEL and improve the luminance imbalance and the color variation due to the voltage drop.

Figure 11:
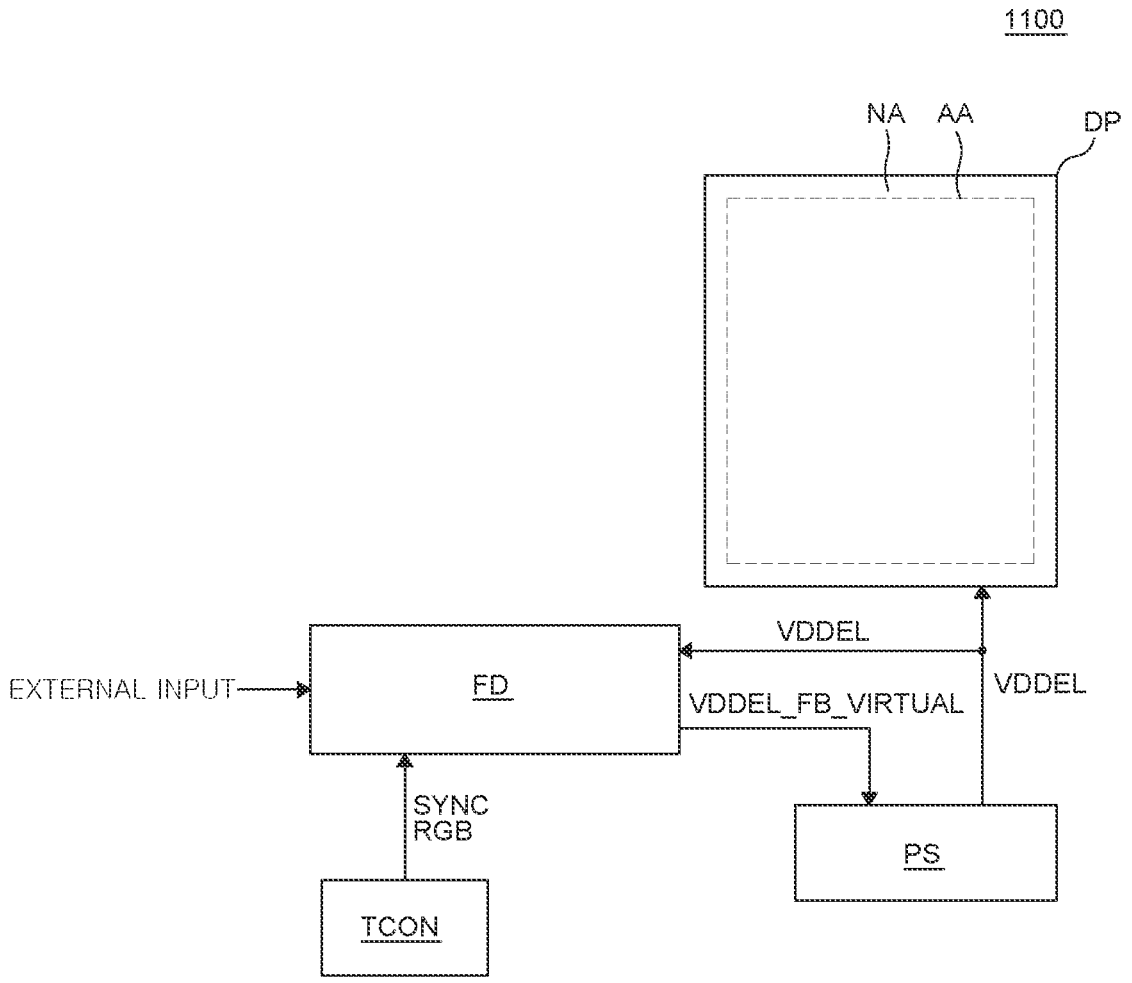
FIG. 11 is a schematic block diagram of a display device according to still another embodiment of the present disclosure.

FIG. 11 is a schematic block diagram of a display device according to still another embodiment of the present disclosure. The only difference between a display device 1100 of FIG. 11 and the display device 100 of FIGS. 1 to 7 is a feedback part FD, but the other configuration is substantially the same, so that a redundant description will be omitted or may be briefly provided.

Referring to FIG. 11, the feedback part FD can generate a virtual feedback voltage VDDEL_FB_VIRTUAL based on an external input. Specifically, the feedback part FD can be applied with a signal from an external electronic device or another electronic component in the display device 1100 to generate a virtual feedback voltage VDDEL_FB_VIRTUAL. For example, during a test process prior to the shipment of the display device 1100, a tester can directly input an external input to the feedback part FD through an external terminal of the display device 1100 to inspect the performance of the display device 1100. Further, an actual user of a display device 1100 can input the external input through an external terminal of the display device 1100 or input the external input using an application installed in the display device 1100. At this time, the tester or the user can set an external input value by means of a luminance and an actual color coordinate measurement value of the display device 1100 to directly apply the control signal CS to the feedback part FD for generating the virtual feedback voltage VDDEL_FB_VIRTUAL.

In some embodiments, as the feedback part FD receives the external input to generate the virtual feedback voltage VDDEL_FB_VIRTUAL, at least one of the controller CTR and the virtual feedback voltage generator VFG of the feedback part FD can be omitted. That is, an external input can correspond to a result of performing some functions among functions of the controller CTR or the virtual feedback voltage generator VFG The display device 1100 according to still another embodiment of the present disclosure can virtually perform the feedback on the high potential power voltage VDDEL without actual feedback on the high potential power voltage VDDEL in the display panel DP. Specifically, as the tester or the user directly inputs the external input for generating the virtual feedback voltage VDDEL_FB_VIRTUAL from the outside, the feedback part FD can perform the compensation for the voltage drop to satisfy the usage purpose of the tester or the user. Further, when the tester or the user applies an external input based on the luminance or the color coordinate which is actually measured, the compensation for the voltage drop can be more precisely performed (e.g., factors for generating the virtual feedback voltage VDDEL_FB_VIRTUAL can be trained or calibrated based on actual/real measurements, such as at the time of manufacture or periodically during the life of the device). Accordingly, the display device 1100 according to still another embodiment of the present disclosure can virtually perform the feedback on the high potential power voltage VDDEL and improve the luminance imbalance and the color variation due to the voltage drop.

Figure 12:
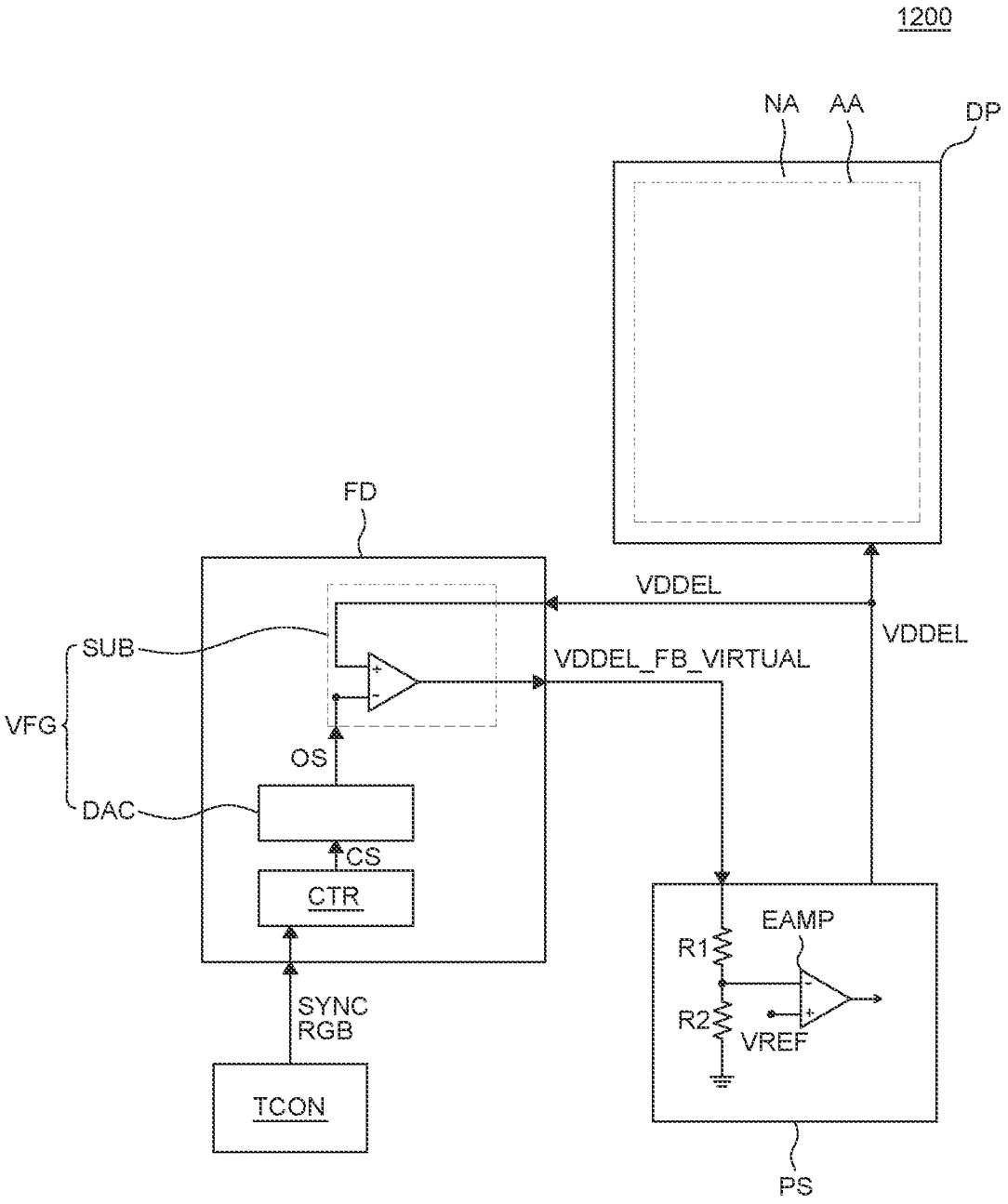
FIG. 12 is a schematic block diagram of a display device according to still another embodiment of the present disclosure.
Figure 13:
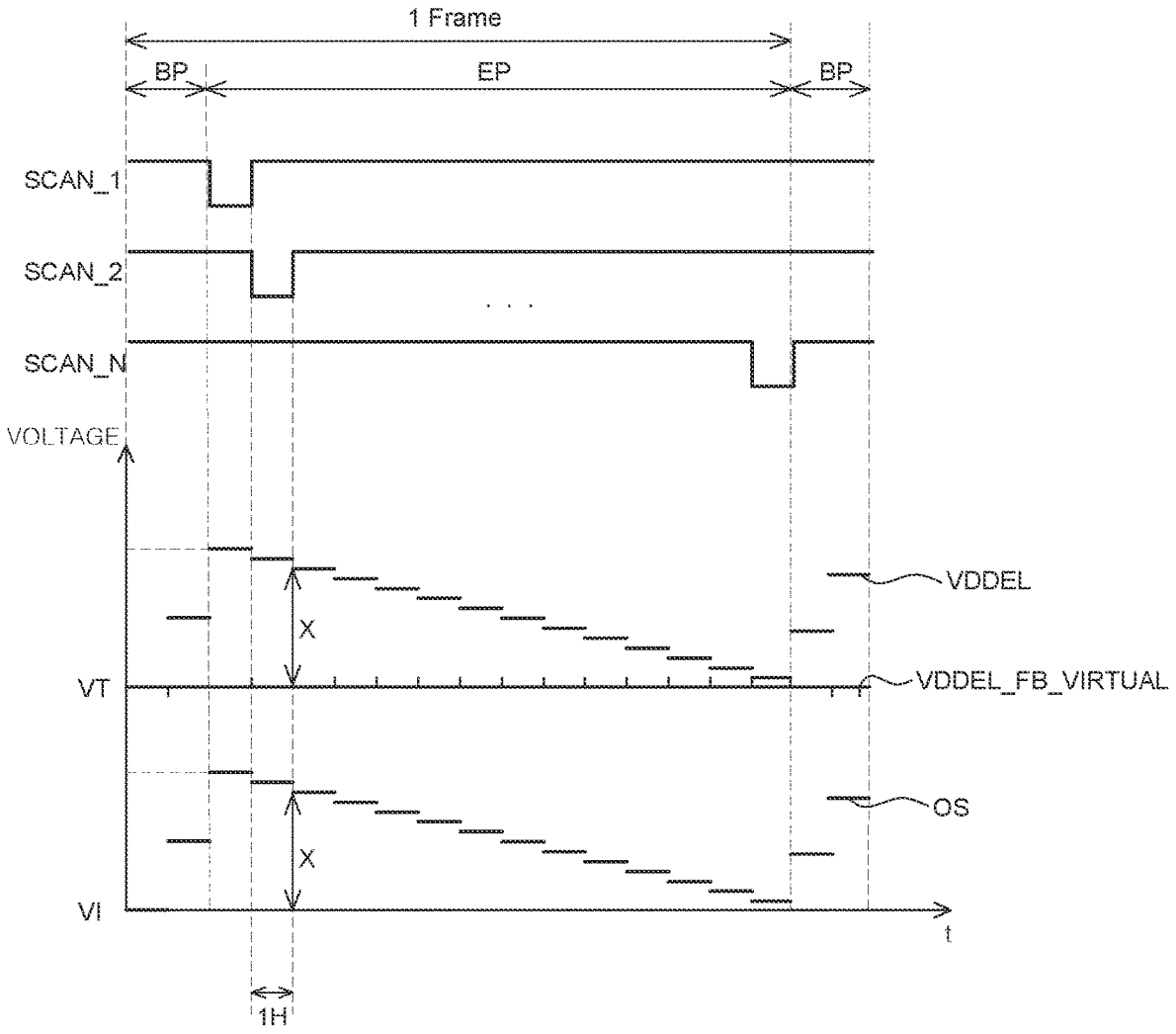
FIG. 13 is a timing diagram for explaining a virtual feedback voltage generator of a feedback part of a display device according to still another embodiment of the present disclosure.

FIG. 12 is a schematic block diagram of a display device according to still another embodiment of the present disclosure. FIG. 13 is a timing diagram for explaining a virtual feedback voltage generator of a feedback unit of a display device according to still another embodiment of the present disclosure. The only difference between a display device 1200 of FIG. 12 and the display device 900 of FIG. 9 is a virtual feedback voltage generator VFG, but the other configuration is substantially the same, so that a redundant description will be omitted or may be briefly provided. FIG. 13 is a timing diagram when a scan signal is applied first to the uppermost sub pixel SP which is the farthest from the inlet which is a location in the display panel DP illustrated in FIG. 12, in which the high potential power voltage VDDEL is applied.

Referring to FIG. 12, the virtual feedback voltage generator VFG includes a digital analog converter DAC which generates an output signal OS at every 1 horizontal period 1 H based on the control signal CS which is an output from the controller CTR and a generator which generates a virtual feedback voltage VDDEL_FB_VIRTUAL based on the output signal OS from the digital analog converter DAC and the high potential power voltage VDDEL. For example, in this way, a linear output wave form can be closely approximated for the output signal OS based on a plurality of discrete values.

Here, the generator can include a subtractor SUB which outputs a difference between the output signal OS and the high potential power voltage VDDEL as a virtual feedback voltage VDDEL_FB_VIRTUAL. The subtractor SUB can be an operational amplifier and generate a virtual feedback voltage VDDEL_FB_VIRTUAL using a difference of a high potential power voltage VDDEL which is applied to a positive (+) terminal and an output signal OS which is applied to a negative (−) terminal.

Referring to FIG. 12, the digital analog converter DAC can generate an output signal OS which increases at an initial voltage VI during the blank period BP.

At this time, the digital analog converter DAC can generate an output signal OS at every 1 horizontal period 1 H. The digital analog converter DAC can receive the control signal CS from the controller CTR at every 1 horizontal period 1 H and generate the output signal OS based on the received control signal CS at every 1 horizontal period 1 H. Further, during one horizontal period 1 H, the output signal OS can maintain the same value.

In FIG. 13, the scan signal is applied first to the uppermost sub pixel SP which is a sub pixel farthest from the inlet which is a location of the display panel DP illustrated in FIG. 12 in which the high potential power voltage VDDEL is applied. Therefore, in order to apply the target voltage VT to a sub pixel SP which is applied with a first scan signal SCAN_1 to be turned on, the high potential power voltage VDDEL which is supplied by the power source PS needs to be higher than the target voltage VT. Therefore, the digital analog converter DAC can generate an output signal OS which increases during the blank period BP. Here, even though the output signal OS tends to increase during the entire blank period BP, the output signal OS can maintain the same value for one horizontal period 1 H.

The digital analog converter DAC generates the output signal OS which increases during the blank period BP so that the difference between the high potential power voltage VDDEL and the output signal OS is reduced. Therefore, the difference between the high potential power voltage VDDEL which is a virtual feedback voltage VDDEL_FB_VIRTUAL generated by the subtractor SUB and the output signal OS can be instantaneously reduced to be lower than the target voltage VT at the beginning of every horizontal period.

Thereafter, the virtual feedback voltage VDDEL_FB_VIRTUAL instantaneously decreases (e.g., as a series of steps). Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, the high potential power voltage VDDEL input to the subtractor SUB is increased so that an input value which is input to a positive (+) terminal of the operational amplifier of the subtractor SUB is increased. Therefore, the difference between the high potential power voltage VDDEL and the output signal OS can be increased. By doing this, the virtual feedback voltage VDDEL_FB_VIRTUAL output from the subtractor SUB can also be increased at the beginning of every horizontal period. However, the virtual feedback voltage VDDEL_FB_VIRTUAL can be maintained as the same value at the timing after every horizontal period. The above-described processes are repeated at every horizontal period so that finally, the virtual feedback voltage VDDEL_FB_VIRTUAL can be substantially maintained to a target voltage VT at a final timing of the blank period BP.

Referring to FIG. 13 again, the digital analog converter DAC can generate an output signal OS which decreases during the emission period EP.

At this time, the digital analog converter DAC can generate an output signal OS at every 1 horizontal period 1 H. The digital analog converter DAC can receive the control signal CS from the controller CTR at every 1 horizontal period 1 H and generate the output signal OS based on the received control signal CS at every 1 horizontal period 1 H. Further, during one horizontal period 1 H, the output signal OS can maintain the same value.

In FIG. 13, the scan signal is applied first to the uppermost sub pixel SP which is farthest from the inlet which is a location in the display panel DP illustrated in FIG. 12 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the digital analog converter DAC can generate the output signal OS which decreases during the emission period EP. Here, even though the output signal OS tends to decrease during the entire emission period EP, the output signal OS can maintain the same value for one horizontal period 1 H.

The digital analog converter DAC generates the output signal OS which decreases during the emission period EP so that the difference between the high potential power voltage VDDEL and the output signal OS is increased. Therefore, the virtual feedback voltage VDDEL_FB_VIRTUAL generated by the subtractor SUB can be instantaneously increased to be higher than the target voltage VT at the beginning of every horizontal period.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, the high potential power voltage VDDEL input to the subtractor SUB is decreased so that an input value which is input to a positive (+) terminal of the operational amplifier of the subtractor SUB is decreased. Therefore, the difference between the high potential power voltage VDDEL and the output signal OS can be decreased. By doing this, the virtual feedback voltage VDDEL_FB_VIRTUAL output from the subtractor SUB can also be decreased at the beginning of every horizontal period. However, the virtual feedback voltage VDDEL_FB_VIRTUAL can be maintained as the same value after every horizontal period. The above-described processes are repeated at every horizontal period so that finally, the virtual feedback voltage VDDEL_FB_VIRTUAL can be substantially maintained as a target voltage VT at a final timing of the emission period EP.

In addition, even though the scan signal is applied first to the lowermost sub pixel SP which is a sub pixel SP closest to the inlet which is a location in which the high potential power voltage VDDEL is applied, the virtual feedback voltage VDDEL_FB_VIRTUAL can be supplied to the power source PS based on the description with reference to FIGS. 7 and 13 (e.g., the powering of the display panel at the beginning of each frame can start with the closest sub pixel or the farthest away sub pixel).

The display device 1200 according to still another embodiment of the present disclosure can virtually perform the feedback on the high potential power voltage VDDEL without actual feedback on the high potential power voltage VDDEL in the display panel DP. That is, the display device 1200 according to still another embodiment of the present disclosure can virtually perform the feedback on the high potential power voltage VDDEL and improve the luminance imbalance and the color variation due to the voltage drop.

Further, in the display device 1200 according to still another embodiment of the present disclosure, the virtual feedback voltage generator VFG includes the digital analog converter DAC which generates an output signal OS at every 1 horizontal period 1 H based on the control signal CS from the controller CTR. Therefore, the virtual feedback voltage generator VFG can perform the feedback on the high potential power voltage VDDEL in the unit of one horizontal period 1 H in real time. The digital analog converter DAC receives a control signal CS from the controller CTR at every 1 horizontal period 1 H. Therefore, the digital analog converter DAC can generate the output signal OS which is input to the subtractor SUB at every 1 horizontal period 1 H to compensate for the high potential power voltage VDDEL to correspond to a degree of the predicted voltage drop at every 1 horizontal period 1 H. Accordingly, the display device 1200 according to still another embodiment of the present disclosure can perform the feedback on the high potential power voltage VDDEL at every 1 horizontal period 1 H rather than at every 1 frame. Therefore, the high potential power voltage VDDEL can be compensated in real time without causing the delay.

Figure 14:
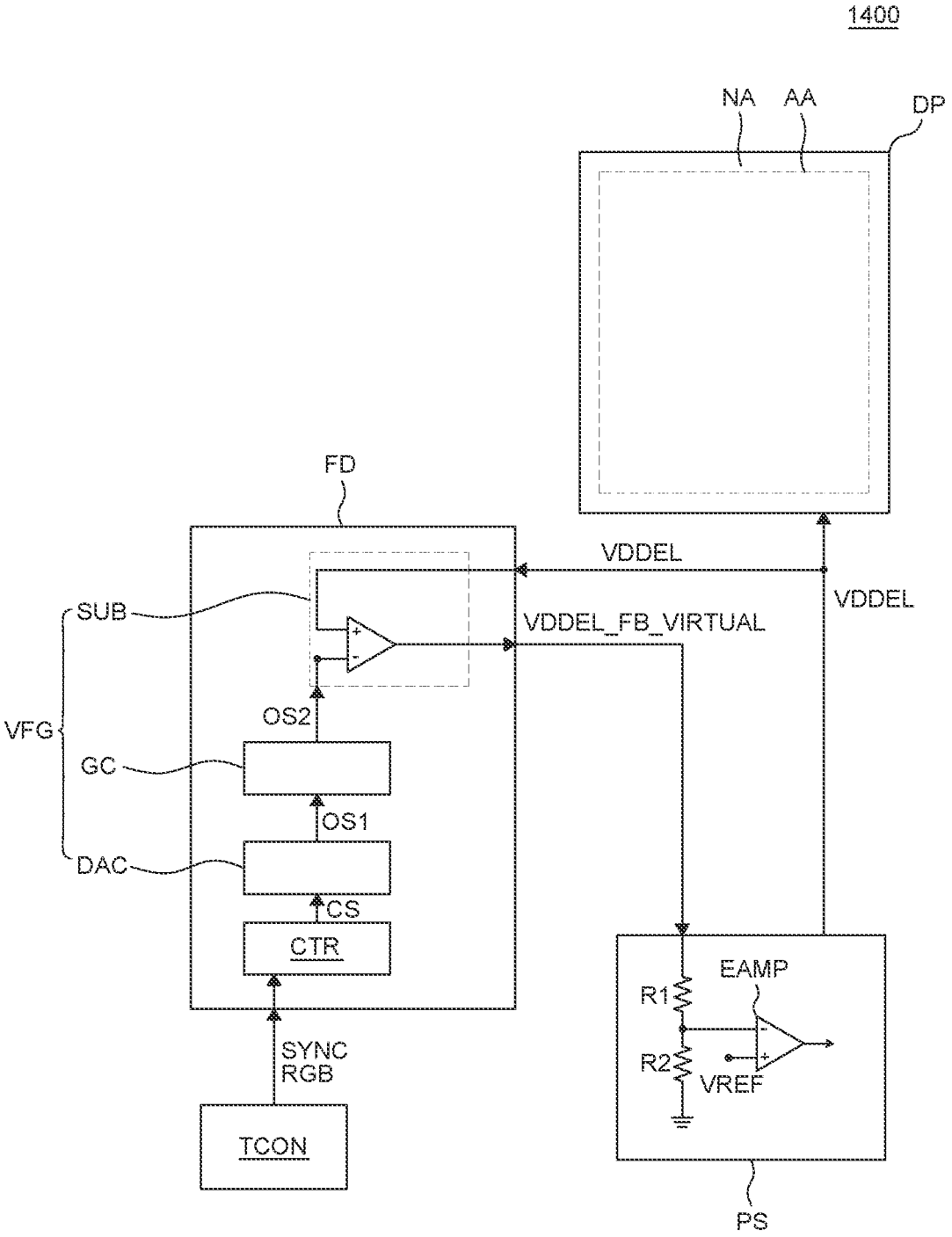
FIG. 14 is a schematic block diagram of a display device according to still another embodiment of the present disclosure.
Figure 15:
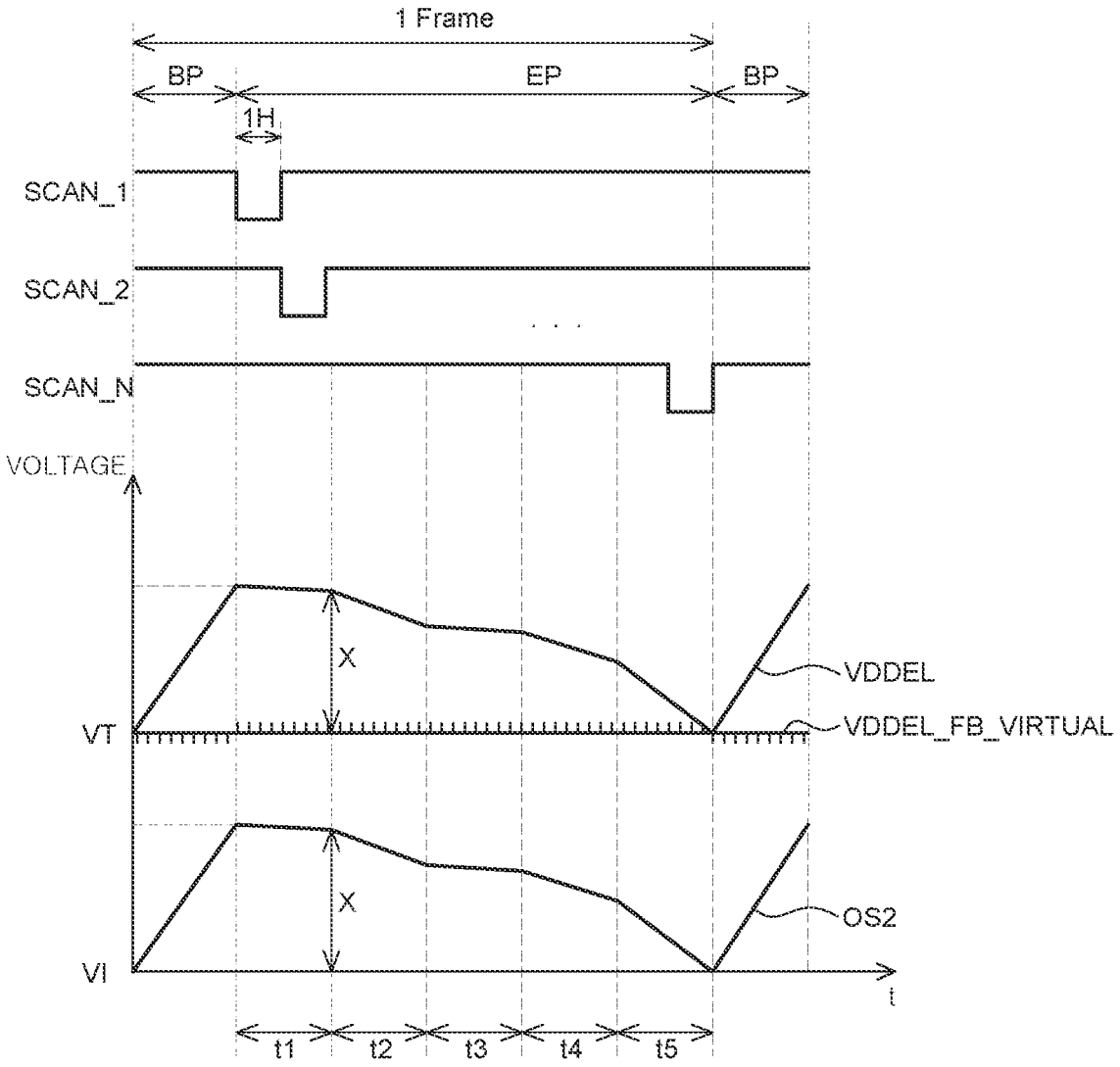
FIG. 15 is a timing diagram for explaining a virtual feedback voltage generator of a feedback part of a display device according to still another embodiment of the present disclosure.

FIG. 14 is a schematic block diagram of a display device according to still another embodiment of the present disclosure. FIG. 15 is a timing diagram for explaining a virtual feedback voltage generator of a feedback unit of a display device according to still another embodiment of the present disclosure. The only difference between a display device 1400 of FIG. 14 and the display device 900 of FIG. 9 is a virtual feedback voltage generator VFG, but the other configuration is substantially the same, so that a redundant description will be omitted or may be briefly provided. FIG. 15 is a timing diagram when a scan signal is applied first to the uppermost sub pixel SP which is the farthest from the inlet which is a location in the display panel DP illustrated in FIG. 14, in which the high potential power voltage VDDEL is applied.

Referring to FIG. 14, the virtual feedback voltage generator VFG includes a digital analog converter DAC, a generator circuit GC, and a generator. The digital analog converter DAC generates a first output signal OS1 at each of the plurality of horizontal periods based on a control signal CS which is an output from the controller CTR. The generator circuit GC generates a second output signal OS2 which linearly or non-linearly decreases or increases based on the first output signal OS1 from the digital analog converter DAC. The generator generates the virtual feedback voltage VDDEL_FB_VIRTUAL based on the second output signal OS2 from the generator circuit GC and the high potential power voltage VDDEL.

Here, the generator can include a subtractor SUB which outputs a difference between the second output signal OS2 and the high potential power voltage VDDEL as a virtual feedback voltage VDDEL_FB_VIRTUAL. The subtractor SUB can be an operational amplifier and generate a virtual feedback voltage VDDEL_FB_VIRTUAL using a difference of a high potential power voltage VDDEL which is applied to a positive (+) terminal and the second output signal OS2 which is applied to a negative (−) terminal.

The digital analog converter DAC can generate the first output signal OS1 which increases at an initial voltage VI during the blank period BP.

At this time, the digital analog converter DAC can generate the first output signal OS1 at every horizontal period among a plurality of horizontal periods. The digital analog converter DAC can receive the control signal CS from the controller CTR at each of a plurality of horizontal periods and generate the first output signal OS1 based on the received control signal CS at each of the plurality of horizontal periods. Here, the blank period BP is a period in which the image is not displayed so that the plurality of horizontal periods can be periods corresponding to the entire blank period BP.

In FIG. 15, the scan signal is applied first to the uppermost sub pixel SP which is a sub pixel farthest from the inlet which is a location in the display panel DP illustrated in FIG. 14 in which the high potential power voltage VDDEL is applied. Therefore, in order to apply the target voltage VT to a sub pixel SP which is applied with a first scan signal SCAN_1 to be turned on, the high potential power voltage VDDEL which is supplied by the power source PS needs to be higher than the target voltage VT. Therefore, the digital analog converter DAC can generate the first output signal OS1 which increases during the blank period BP.

Referring to FIG. 15, the generator circuit GC can generate a second output signal OS2 which increases at an initial voltage VI during the blank period BP. Specifically, the generator circuit GC receives the first output signal OS1 which increases at the initial voltage VI to generate the second output signal OS2 which increases to correspond to the first output signal OS1.

The generator circuit GC generates the second output signal OS2 which increases during the blank period BP so that the difference between the high potential power voltage VDDEL and the second output signal OS2 is reduced. Therefore, the difference between the high potential power voltage VDDEL which is a virtual feedback voltage VDDEL_FB_VIRTUAL generated by the subtractor SUB and the second output signal OS2 can be instantaneously reduced to be lower than the target voltage VT. For example, the second output signal OS2 and the compensated high potential power voltage VDDEL can have a direct relationship or a positive correlation.

Thereafter, the virtual feedback voltage VDDEL_FB_VIRTUAL instantaneously decreases (e.g., see the plurality of discrete impulse values in FIG. 15). Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, the high potential power voltage VDDEL input to the subtractor SUB is increased so that an input value which is input to a positive (+) terminal of the operational amplifier of the subtractor SUB. Therefore, the difference between the high potential power voltage VDDEL and the second output signal OS2 can be increased. By doing this, the virtual feedback voltage VDDEL_FB_VIRTUAL output from the subtractor SUB can also be increased. Accordingly, the virtual feedback voltage VDDEL_FB_VIRTUAL can be substantially maintained as a target voltage VT.

The digital analog converter DAC can generate the first output signal OS1 which decreases during the emission period EP.

At this time, the digital analog converter DAC can generate the first output signal OS1 at each of the plurality of horizontal periods. The digital analog converter DAC can receive the control signal CS from the controller CTR at each of the plurality of horizontal periods and generate the first output signal OS1 based on the received control signal CS at each of the plurality of horizontal periods. Even though in FIG. 15, it is illustrated that the plurality of horizontal periods is two horizontal periods 2 H, it is not limited thereto. Further, in FIG. 15, it is assumed that one frame is formed of five time intervals t1, t2, t3, t4, and t5 and one time interval is a time interval corresponding to a plurality of horizontal periods, that is, two horizontal periods 2 H.

In FIG. 15, the scan signal is applied first to the uppermost sub pixel SP which is farthest from the inlet which is a location in the display panel DP illustrated in FIG. 14 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the digital analog converter DAC can generate the first output signal OS1 which decreases during the emission period EP. Here, even though the first output signal OS1 tends to decrease during the entire emission period EP, the first output signal OS1 can maintain the same value for the plurality of horizontal periods.

Referring to FIG. 15, the generator circuit GC can generate a second output signal OS2 which decreases during the emission period EP. Specifically, the generator circuit GC receives the first output signal OS1 which decreases during the emission period EP to generate the second output signal OS2 which decreases to correspond to the first output signal OS1.

At this time, the second output signal OS2 which is output from the generator circuit GC can differently decrease at each of the plurality of horizontal periods. As described above, the generator circuit GC can receive the first output signal OS1 which has different values at each of the plurality of horizontal periods and generate the second output signal OS2 which decreases to correspond to the first output signal OS1. Therefore, as illustrated in FIG. 15, the second output signal OS2 which has different decreasing degrees at every five time intervals t1, t2, t3, t4, and t5, that is, has different gradients on the graph. However, it is not limited thereto so that if the first output signal OS1 has the same value at each of the plurality of horizontal periods, the gradient of the second output signal OS2 can be constant in the emission period EP.

The generator circuit GC generates the second output signal OS2 which decreases during the emission period EP so that the difference between the high potential power voltage VDDEL and the second output signal OS2 is increased. Therefore, the virtual feedback voltage VDDEL_FB_VIRTUAL generated by the subtractor SUB can be instantaneously increased to be higher than the target voltage VT.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, the high potential power voltage VDDEL input to the subtractor SUB is decreased so that an input value which is input to a positive (+) terminal of the operational amplifier of the subtractor SUB is decreased. Therefore, the difference between the high potential power voltage VDDEL and the second output signal OS2 can be decreased. By doing this, the virtual feedback voltage VDDEL_FB_VIRTUAL output from the subtractor SUB can also be decreased. Accordingly, the virtual feedback voltage VDDEL_FB_VIRTUAL can be substantially maintained as a target voltage VT.

In addition, even though the scan signal is applied first to the lowermost sub pixel SP which is a sub pixel SP closest to the inlet which is a location in which the high potential power voltage VDDEL is applied, the virtual feedback voltage VDDEL_FB_VIRTUAL can be supplied to the power source PS based on the description with reference to FIGS. 7 and 15 (e.g., the sub pixel that is located farthest away from the power inlet can be powered first and vice versa).

The display device 1400 according to still another embodiment of the present disclosure can virtually perform the feedback on the high potential power voltage VDDEL without actual feedback on the high potential power voltage VDDEL in the display panel DP. That is, the display device 1400 according to still another embodiment of the present disclosure can virtually perform the feedback on the high potential power voltage VDDEL and improve the luminance imbalance and the color variation due to the voltage drop, while saving space and avoiding extra hardware and wiring.

Further, in the display device 1400 according to still another embodiment of the present disclosure, the virtual feedback voltage generator VFG includes the digital analog converter DAC and the generator circuit GC to feedback on the high potential power voltage VDDEL in the unit of a plurality of horizontal periods. The digital analog converter DAC generates the first output signal OS1 at each of the plurality of horizontal periods based on the control signal CS from the controller CTR. The generator circuit GC generates the second signal OS2 which linearly or non-linearly decreases or increases based on the first output signal OS1 from the digital analog converter DAC. Desirably, the high potential power voltage VDDEL can be fed-back at every horizontal period using the digital analog converter DAC. However, when the display device 1400 is driven at a high speed, one horizontal period 1 H can be very short. In this situation, the feedback on the high potential power voltage VDDEL can be difficult to perform at every 1 horizontal period 1 H due to the performance limit of the digital analog converter DAC. Accordingly, in the display device 1400 according to still another embodiment of the present disclosure, the generator circuit GC is used together with the digital analog converter DAC which generates the first output signal OS1 at each of the plurality of horizontal periods. Therefore, the feedback on the high potential power voltage VDDEL can be performed at each of the plurality of horizontal periods which is a time interval longer than one horizontal period 1 H. Accordingly, the feedback on the high potential power voltage VDDEL can be performed in the unit of a fastest time interval as much as possible based on the performance of the digital analog converter DAC.

Figure 16:
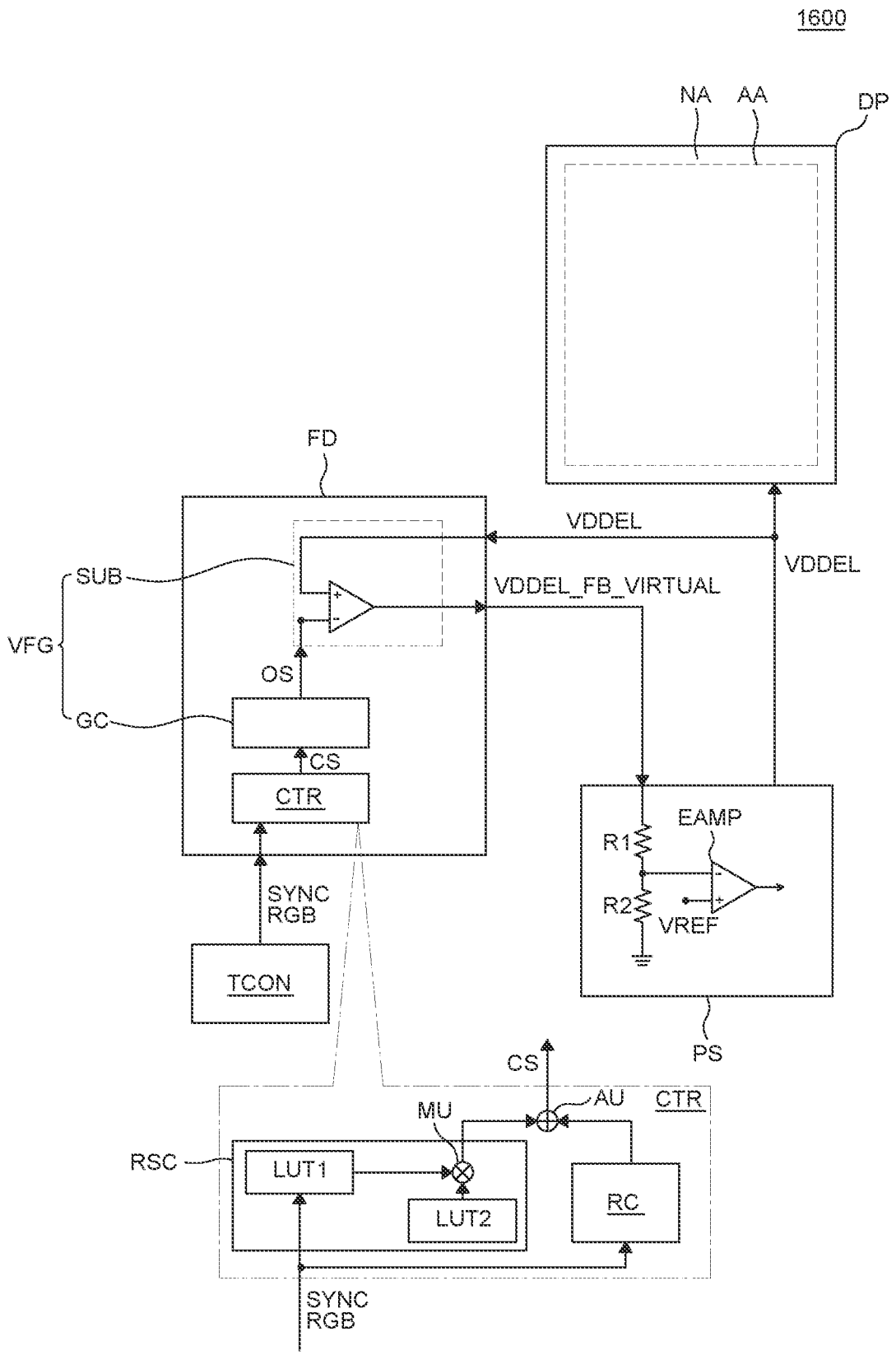
FIG. 16 is a schematic block diagram of a display device according to still another embodiment of the present disclosure.
Figure 17:
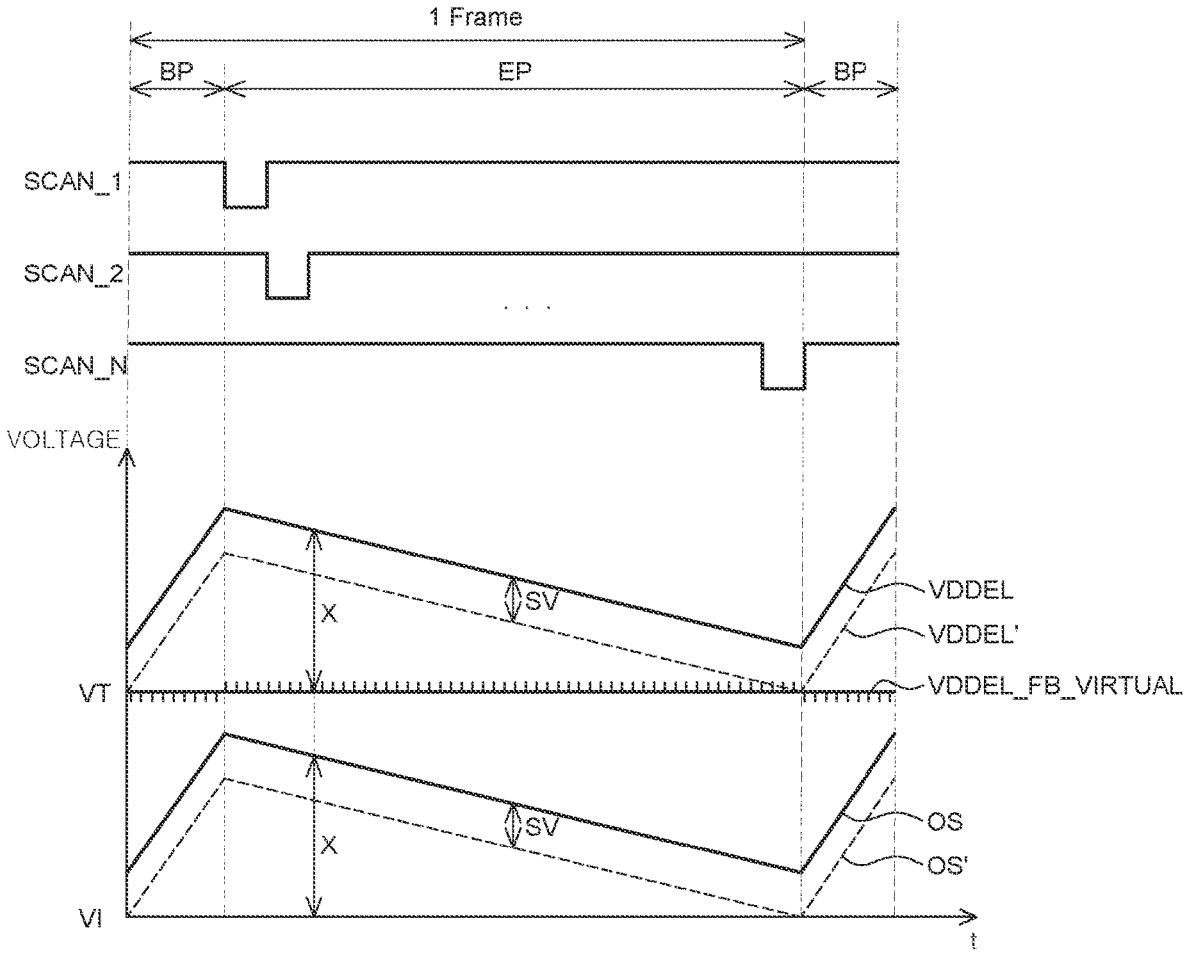
FIG. 17 is a timing diagram for explaining a virtual feedback voltage generator of a feedback part of a display device according to still another embodiment of the present disclosure.

FIG. 16 is a schematic block diagram of a display device according to still another embodiment of the present disclosure. FIG. 17 is a timing diagram for explaining a virtual feedback voltage generator of a feedback part of a display device according to still another embodiment of the present disclosure. The only difference between a display device 1600 of FIG. 16 and the display device 900 of FIG. 9 is a controller CTR, but the other configuration is substantially the same, so that a redundant description will be omitted or may be briefly provided. FIG. 17 is a timing diagram when a scan signal is applied first to the uppermost sub pixel SP which is the farthest from the inlet which is a location in the display panel DP illustrated in FIG. 16, in which the high potential power voltage VDDEL is applied. A specific enlarged diagram of the controller CTR is illustrated at the lower portion of FIG. 16.

Referring to FIG. 16, the controller CTR can generate the control signal CS to compensate for a voltage drop amount SV of the high potential power voltage VDDEL which is generated between an output terminal of the power source PS and the display panel DP. The power source PS can be mounted in a separate substrate such as a printed circuit board which is electrically connected to the display panel DP. At this time, even during the process of transmitting the high potential power voltage VDDEL from the output terminal of the power source PS disposed on the printed circuit board to the display panel DP, the voltage drop of the high potential power voltage VDDEL can occur due to the resistance of the wiring line. The controller CTR can be configured to generate a control signal CS which reflects the compensation for the voltage drop amount SV of the above-described high potential power voltage VDDEL. Even though in the present example embodiment, the controller CTR generates the control signal CS for compensating for the voltage drop amount SV of the high potential power voltage VDDEL generated between the output terminal of the power source PS and the display panel DP, it is not limited thereto. Therefore, the controller CTR can generate a control signal for compensating for the voltage drop amount SV of the high potential power voltage VDDEL generated between the output terminal of the power source PS and the inlet which is a location in the display panel DP in which the high potential power voltage VDDEL is applied.

Specifically, referring to FIG. 16, the controller CTR includes a voltage drop amount calculator RSC, a variation calculator RC, and an adder AU.

The voltage drop amount calculator RSC calculates a voltage drop amount SV of the high potential power voltage VDDEL generated between the output terminal of the power source PS and the display panel DP from the image data RGB. The voltage drop amount SV of the high potential power voltage VDDEL generated between the output terminal of the power source PS and the display panel DP can be assumed as a multiplication of a current flowing through a wiring line which connects the output terminal of the power source PS and the display panel DP and a resistance of the wiring line. Therefore, the voltage drop amount SV of the high potential power voltage VDDEL generated between the output terminal of the power source PS and the display panel DP can be calculated from the current flowing through a wiring line which connects the output terminal of the power source PS and the display panel DP and a resistance of the wiring line.

Specifically, the voltage drop amount calculator RSC includes a first look-up table LUT1, a second look-up table LUT2, and a multiplier MU.

In the first look-up table LUT1, a current amount flowing from the output terminal of the power source PS to the display panel DP corresponding to or based on the image data RGB can be stored. The first look-up table LUT1 can output a current amount flowing from the output terminal of the power source PS to the display panel DP corresponding to the image data RGB input to the first look-up table LUT1 to the multiplier MU.

In the second look-up table LUT2, a resistance between the output terminal of the power source PS and the display panel DP can be stored. During the process of manufacturing the display device 1600, the resistance between the output terminal of the power source PS and the display panel DP is measured to be stored in the second look-up table LUT2 (e.g., at the time of manufacture or at a calibration event). Alternatively, during the process of using the display device 1600, the resistance between the output terminal of the power source PS and the display panel DP can be updated by the user. However, it is not limited thereto and in the second look-up table LUT2, a resistance between the output terminal of the power source PS and the inlet which is a location in the display panel DP in which the high potential power voltage VDDEL is applied can be stored.

The second look-up table LUT2 can output the stored resistance between the output terminal of the power source PS and the display panel DP to the multiplier MU.

The multiplier MU can calculate the voltage drop amount SV by multiplying an output from the first look-up table LUT1 and an output from the second look-up table LUT2. As described above, the multiplier MU can receive a current amount flowing from the output terminal of the power source PS to the display panel DP corresponding to the image data RGB from the first look-up table LUT1. Further, the multiplier MU can receive a resistance between the output terminal of the power source PS and the display panel DP from the second look-up table LUT2. Therefore, the multiplier MU multiplies the current amount flowing from the output terminal of the power source PS to the display panel DP and the resistance between the output terminal of the power source PS and the display panel DP. By doing this, the multiplier MU can calculate the voltage drop amount SV of the high potential power voltage VDDEL generated between the output terminal of the power source PS and the display panel DP.

The variation calculator RC can calculate a variation of the output signal OS of the generator circuit GC which linearly or non-linearly decreases or increases, from the image data RGB. The output of the variation calculator RC is substantially the same as the output of the controller CTR of the display device 900 which has been described with reference to FIG. 9 so that a redundant description will be omitted or may be briefly provided.

The adder AU can add the voltage drop amount SV and the variation to generate a control signal CS. The adder AU can add outputs of the voltage drop amount calculator RSC and the variation calculator RC to generate a control signal CS.

Referring to FIG. 17, the virtual feedback voltage generator VFG includes a generator circuit GC and a subtractor SUB. The generator circuit GC generates an output signal OS linearly or non-linearly decreasing or increasing based on the control signal CS which is an output from the controller CTR. The subtractor SUB generates a virtual feedback voltage VDDEL_FB_VIRTUAL based on a difference between the output signal OS from the generator circuit GC and the high potential power voltage VDDEL. A basic driving method of the generator circuit GC and the subtractor SUB is substantially the same as the driving method of the generator circuit GC and the subtractor SUB which has been described with reference to FIG. 9 so that a redundant description will be omitted or may be briefly provided.

As illustrated in FIG. 17, the output signal OS of the generator circuit GC can be a sum of the output signal OS' in which the voltage drop of the high potential power voltage VDDEL generated between the output terminal of the power source PS and the display panel DP is not considered and a voltage drop amount SV calculated by the voltage drop calculating unit RSC. As the output signal OS of the generator circuit GC and the voltage drop amount SV are added, the high potential power voltage VDDEL can also be calculated as the sum of the high potential power voltage VDDEL' in which the voltage drop of the high potential power voltage VDDEL generated between the output terminal of the power source PS and the display panel DP is not considered and the voltage drop amount SV. Therefore, as illustrated in FIG. 17, both the high potential power voltage VDDEL and the output signal OS can be values increased by the voltage drop amount SV calculated by the voltage drop amount calculator RSC.

The display device 1600 according to still another embodiment of the present disclosure can virtually perform the feedback on the high potential power voltage VDDEL without actual feedback on the high potential power voltage VDDEL in the display panel DP. That is, the display device 1600 according to still another embodiment of the present disclosure can virtually perform the feedback on the high potential power voltage VDDEL and improve the luminance imbalance and the color variation due to the voltage drop.

Further, in the display device 1600 according to still another embodiment of the present disclosure, the voltage drop amount SV of the high potential power voltage VDDEL generated between the output terminal of the power source PS and the display panel DP can be compensated. Specifically, the voltage drop amount SV of the high potential power voltage VDDEL generated between the output terminal of the power source PS and the display panel DP can be calculated using the voltage drop amount calculator RSC and the variation calculator RC. The voltage drop amount calculator RSC calculates the voltage drop amount SV of the high potential power voltage VDDEL generated between the output terminal of the power source PS and the display panel DP from the image data RGB. The variation calculator RC calculates a variation of the output signal OS of the generator circuit GC which linearly or non-linearly decreases or increases from the image data RGB. Therefore, in the display device 1600 according to still another embodiment of the present disclosure, the high potential power voltage VDDEL is increased by the voltage drop amount SV of the high potential power voltage VDDEL generated between the output terminal of the power source PS and the display panel DP to compensate for additional voltage drop of the high potential power voltage VDDEL.

Figure 18:
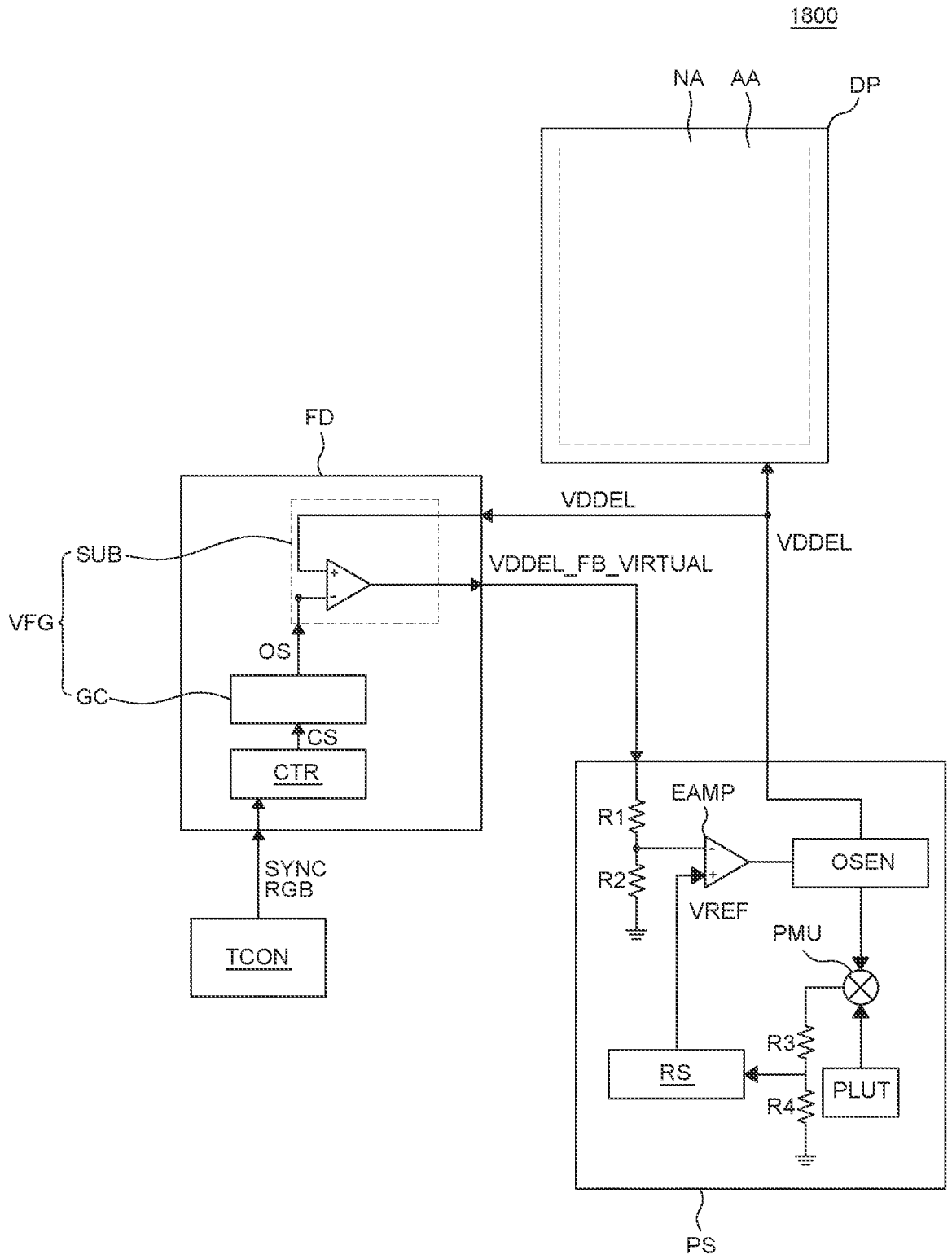
FIG. 18 is a schematic block diagram of a display device according to still another embodiment of the present disclosure.
Figure 19:
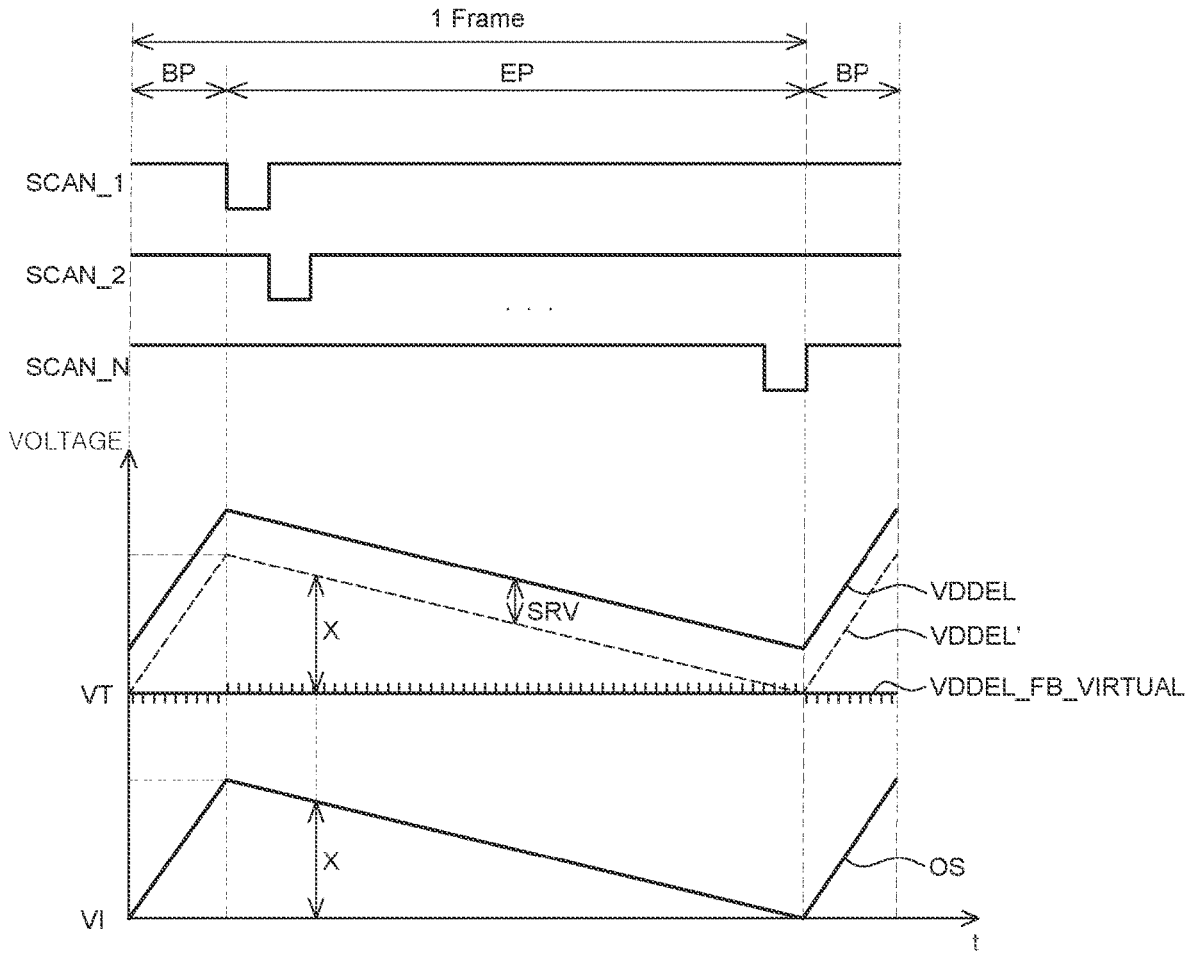
FIG. 19 is a timing diagram for explaining a virtual feedback voltage generator of a feedback part of a display device according to still another embodiment of the present disclosure.

FIG. 18 is a schematic block diagram of a display device according to still another embodiment of the present disclosure. FIG. 19 is a timing diagram for explaining a virtual feedback voltage generator of a feedback unit of a display device according to still another embodiment of the present disclosure. The only difference between a display device 1800 of FIG. 18 and the display device 900 of FIG. 9 is a power source PS having a different configuration, but the other configuration is substantially the same, so that a redundant description will be omitted or may be briefly provided. FIG. 19 is a timing diagram when a scan signal is applied first to the uppermost sub pixel SP which is the farthest from the inlet which is a location in the display panel DP illustrated in FIG. 18, in which the high potential power voltage VDDEL is applied.

Referring to FIG. 18, the power source PS can compensate for the voltage drop amount of the high potential power voltage VDDEL generated between the output terminal of the power source PS and the display panel DP. In order to compensate for the voltage drop amount, the power source PS includes an error amplifier EAMP, a first resistor R1, a second resistor R2, a third resistor R3, a fourth resistor R4, a sensor OSEN, a power look-up table PLUT, a power multiplier PMU, and a reference voltage source RS. The error amplifier EAMP, the first resistor R1, and the second resistor R2 are the same as the error amplifier EAMP, the first resistor R1, and the second resistor R2 which have been described with reference to FIG. 7 so that a redundant description will be omitted or may be briefly provided.

The sensor OSEN senses a current value output to the output terminal of the power source PS based on the output of the error amplifier EAMP. The sensor OSEN can sense an output of the error amplifier EAMP, that is, a current value output to the output terminal of the power source PS from the high potential power voltage VDDEL.

In the power look-up table PLUT, a resistance between the output terminal of the power source PS and the display panel DP can be stored. During the process of manufacturing the display device 1800, the resistance between the output terminal of the power source PS and the display panel DP is measured to be stored in the power look-up table PLUT (e.g., calibrated at the time of manufacture). Alternatively, during the process of using the display device 1800, the resistance between the output terminal of the power source PS and the display panel DP can be updated by the user or a technician (e.g., recalibrated). However, it is not limited thereto and in the power look-up table PLUT, a resistance between the output terminal of the power source PS and the inlet which is a location in the display panel DP in which the high potential power voltage VDDEL is applied can be stored.

The power multiplier PMU multiplies the output from the sensor OSEN and the output from the power look-up table PLUT to calculate the voltage drop amount. As described above, the power multiplier PMU can receive the current amount flowing from the output terminal of the power source PS to the display panel DP, from the sensor OSEN. Further, the power multiplier PMU can receive a resistance between the output terminal of the power source PS and the display panel DP from the power look-up table PLUT. Therefore, the power multiplier PMU multiplies a current value flowing from the output terminal of the power source PS to the display panel DP and the resistance between the output terminal of the power source PS and the display panel DP. By doing this, the power multiplier PMU can calculate the voltage drop amount of the high potential power voltage VDDEL generated between the output terminal of the power source PS and the display panel DP.

The reference voltage source RS can adjust a magnitude of the reference voltage VREF based on the output of the power multiplier PMU. The reference voltage source RS can receive a divided voltage value by the third resistor R3 and the fourth resistor R4 of the output of the power multiplier PMU and adjust the magnitude of the reference voltage VREF in accordance with the input value. For example, when the output of the power multiplier PMU is increased, the magnitude of the reference voltage VREF is increased so that the output of the error amplifier EAMP can be increased. Further, when the output of the power multiplier PMU is decreased, the magnitude of the reference voltage VREF is decreased so that the output of the error amplifier EAMP can be decreased.

Referring to FIG. 19, the virtual feedback voltage generator VFG includes a generator circuit GC and a subtractor SUB. The generator circuit GC generates an output signal OS linearly or non-linearly decreasing or increasing based on the control signal CS which is an output from the controller CTR. The subtractor SUB generates a virtual feedback voltage VDDEL_FB_VIRTUAL based on a difference between the output signal OS from the generator circuit GC and the high potential power voltage VDDEL. A basic driving method of the generator circuit GC and the subtractor SUB is substantially the same as the driving method of the generator circuit GC and the subtractor SUB which has been described with reference to FIG. 9 so that a redundant description will be omitted or may be briefly provided.

As illustrated in FIG. 19, the high potential power voltage VDDEL can be calculated by a sum of the high potential power voltage VDDEL' in which the voltage drop of the high potential power voltage VDDEL generated between the output terminal of the power source PS and the display panel DP is not considered and the reference voltage variation SRV. Therefore, as illustrated in FIG. 19, the high potential power voltage VDDEL can be obtained by shifting the high potential power voltage VDDEL' in which the voltage drop of the high potential power voltage VDDEL generated between the output terminal of the power source PS and the display panel DP is not considered, by the reference voltage variation SRV.

The display device 1800 according to still another embodiment of the present disclosure can virtually perform the feedback on the high potential power voltage VDDEL without actual feedback on the high potential power voltage VDDEL in the display panel DP. That is, the display device 1800 according to still another embodiment of the present disclosure can virtually perform the feedback on the high potential power voltage VDDEL and improve the luminance imbalance and the color variation due to the voltage drop.

Further, in the display device 1800 according to still another embodiment of the present disclosure, the voltage drop amount of the high potential power voltage VDDEL generated between the output terminal of the power source PS and the display panel DP can be compensated. Specifically, the sensor OSEN senses a current value output to the output terminal of the power source PS based on the output of the error amplifier EAMP and in the power look-up table PLUT, the resistance between the output terminal of the power source PS and the display panel DP can be stored. The power multiplier PMU multiplies the output from the sensor OSEN and the output from the power look-up table PLUT to calculate the voltage drop amount and adjust a magnitude of the reference voltage VREF based on the calculated voltage drop amount. Therefore, in the display device 1800 according to still another embodiment of the present disclosure, the magnitude of the reference voltage VREF of the error amplifier EAMP is adjusted based on the voltage drop amount. By doing this, the high potential power voltage VDDEL is increased by the voltage drop amount of the high potential power voltage VDDEL generated between the output terminal of the power source PS and the display panel DP to compensate for additional voltage drop of the high potential power voltage VDDEL.

Figure 20:
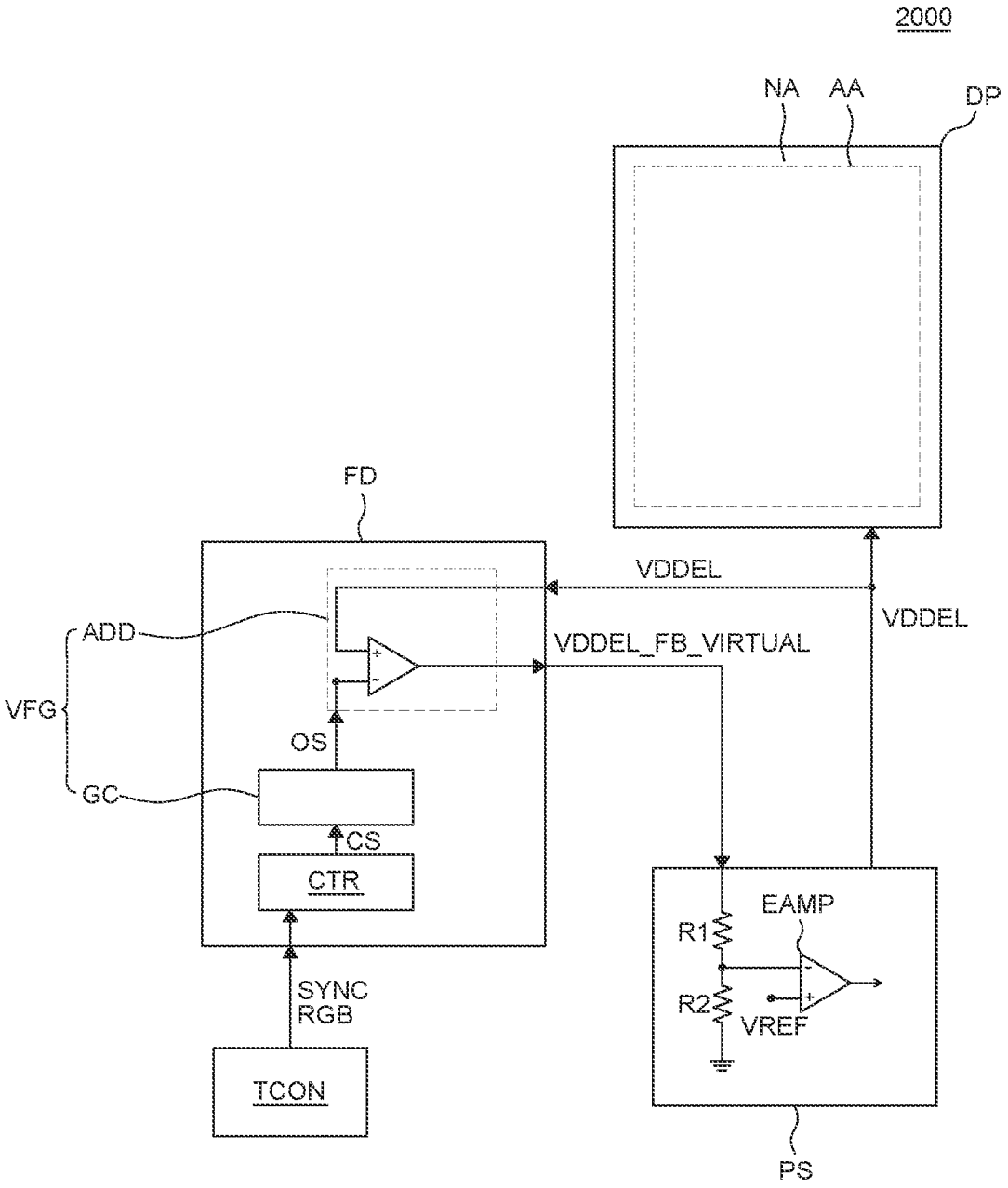
FIG. 20 is a schematic block diagram of a display device according to still another embodiment of the present disclosure.
Figure 21:
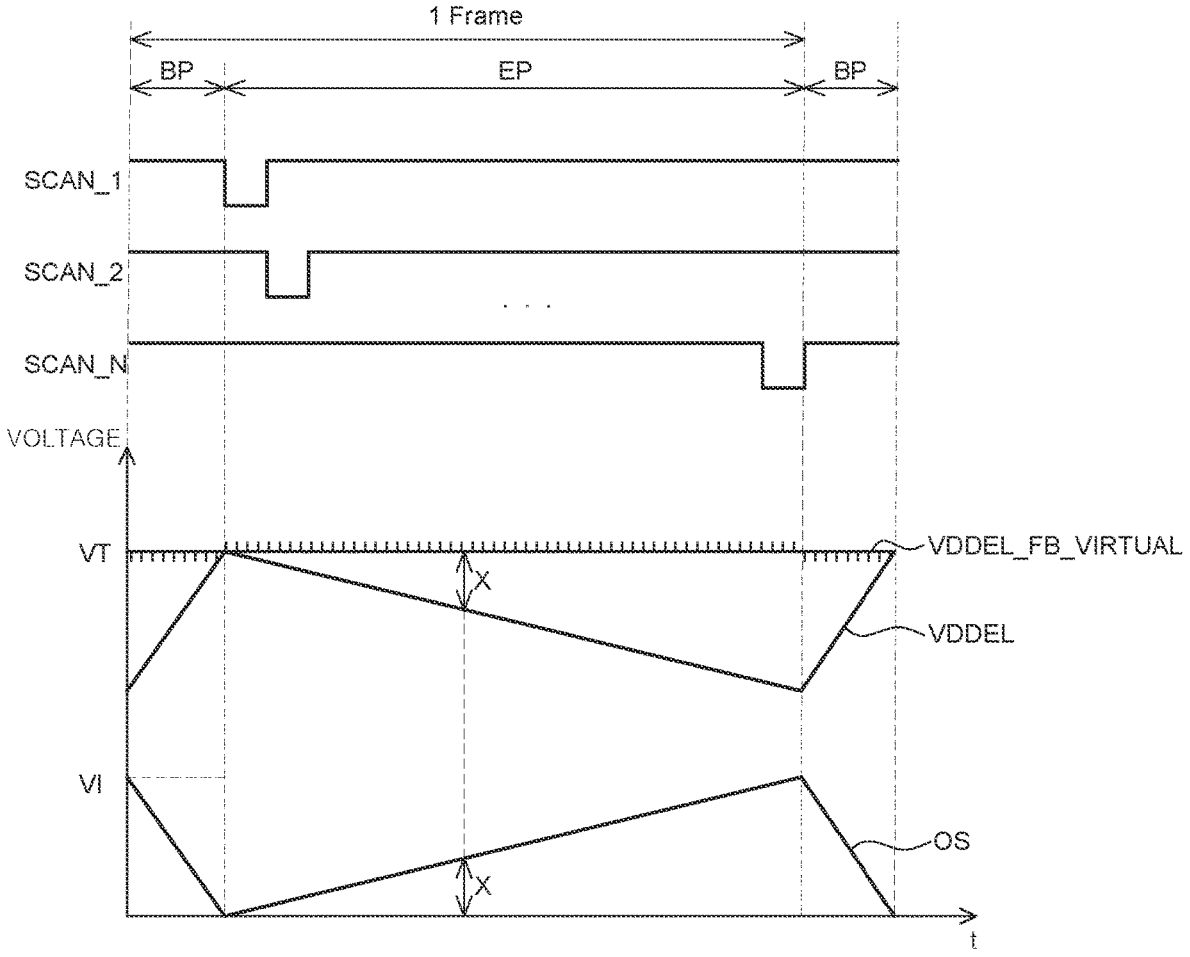
FIG. 21 is a timing diagram for explaining a virtual feedback voltage generator of a feedback part of a display device according to still another embodiment of the present disclosure.

FIG. 20 is a schematic block diagram of a display device according to still another embodiment of the present disclosure. FIG. 21 is a timing diagram for explaining a virtual feedback voltage generator of a feedback part of a display device according to still another embodiment of the present disclosure. The only difference between a display device 2000 of FIG. 20 and the display device 900 of FIG. 9 is a virtual feedback voltage generator VFG, but the other configuration is substantially the same, so that a redundant description will be omitted or may be briefly provided. FIG. 21 is a timing diagram when a scan signal is applied first to the uppermost sub pixel SP which is the farthest from the inlet which is a location in the display panel DP illustrated in FIG. 20, in which the high potential power voltage VDDEL is applied.

Referring to FIG. 20, the virtual feedback voltage generator VFG includes a generator circuit GC and a generator. The generator circuit GC generates an output signal OS linearly or non-linearly decreasing or increasing based on the control signal CS which is an output from the controller CTR. The generator generates a virtual feedback voltage VDDEL_FB_VIRTUAL based on the output signal OS from the generator circuit GC and the high potential power voltage VDDEL.

Here, the generator can include an adder ADD which outputs a sum of the output signal OS and the high potential power voltage VDDEL as a virtual feedback voltage VDDEL_FB_VIRTUAL. The adder ADD can be an operational amplifier and generate a virtual feedback voltage VDDEL_FB_VIRTUAL using a sum of a high potential power voltage VDDEL which is applied to a positive (+) terminal and an output signal OS which is applied to a negative (−) terminal.

Referring to FIG. 21, the generator circuit GC can generate an output signal OS which decreases at an initial voltage VI during the blank period BP. In FIG. 21, the scan signal is applied first to the uppermost sub pixel SP which is a sub pixel farthest from the inlet which is a location of the display panel DP illustrated in FIG. 20 in which the high potential power voltage VDDEL is applied. Therefore, in accordance with the design of the power source PS, a target voltage VT is applied to a sub pixel SP which is applied with a first scan signal SCAN_1 to be turned on and then the high potential power voltage VDDEL can be decreased. Therefore, the generator circuit GC can generate an output signal OS which decreases during the blank period BP (e.g., the output signal OS and the high potential power voltage VDDEL can be inversely related).

The generator circuit GC generates the output signal OS which decreases during the blank period BP so that the sum of the high potential power voltage VDDEL and the output signal OS is reduced. Therefore, the difference between the high potential power voltage VDDEL which is a virtual feedback voltage VDDEL_FB_VIRTUAL generated by the adder ADD and the output signal OS can be instantaneously reduced to be lower than the target voltage VT.

Thereafter, the virtual feedback voltage VDDEL_FB_VIRTUAL instantaneously decreases. Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, since the high potential power voltage VDDEL input to the adder ADD is increased so that an input value which is input to a positive (+) terminal of the operational amplifier of the adder ADD, the sum of the high potential power voltage VDDEL and the output signal OS can be increased. By doing this, the virtual feedback voltage VDDEL_FB_VIRTUAL output from the adder ADD can also be increased. Accordingly, the virtual feedback voltage VDDEL_FB_VIRTUAL can be substantially maintained as a target voltage VT.

Referring to FIG. 21 again, the generator circuit GC can generate an output signal OS which increases during the emission period EP. In FIG. 21, the scan signal is applied first to the uppermost sub pixel SP which is farthest from the inlet which is a location in the display panel DP illustrated in FIG. 20 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the generator circuit GC can generate the output signal OS which increases during the emission period EP.

The generator circuit GC generates the output signal OS which increases during the emission period EP so that the sum of the high potential power voltage VDDEL and the output signal OS is increased. Therefore, the virtual feedback voltage VDDEL_FB_VIRTUAL generated by the adder ADD can be instantaneously increased to be higher than the target voltage VT.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, since the high potential power voltage VDDEL input to the adder ADD is decreased so that an input value which is input to a positive (+) terminal of the operational amplifier of the adder ADD, the sum of the high potential power voltage VDDEL and the output signal OS can be decreased. By doing this, the virtual feedback voltage VDDEL_FB_VIRTUAL output from the adder ADD can also be decreased. Accordingly, the virtual feedback voltage VDDEL_FB_VIRTUAL can be substantially maintained as a target voltage VT.

In addition, even though the scan signal is applied first to the lowermost sub pixel SP which is a sub pixel SP closest to the inlet which is a location in which the high potential power voltage VDDEL is applied, the virtual feedback voltage VDDEL_FB_VIRTUAL can be supplied to the power source PS based on the description with reference to FIGS. 7 and 21.

The display device 2000 according to still another embodiment of the present disclosure can virtually perform the feedback on the high potential power voltage VDDEL without using actual/real feedback on the high potential power voltage VDDEL in the display panel DP. That is, the display device 2000 according to still another embodiment of the present disclosure can virtually perform the feedback on the high potential power voltage VDDEL and improve the luminance imbalance and the color variation due to the voltage drop. Specifically, in the display device 2000 according to still another embodiment of the present disclosure, in accordance with the design of the power source PS, the target voltage VT is applied to a sub pixel SP which is applied with the first scan signal SCAN_1 to be turned on. Thereafter, even though the high potential power voltage VDDEL is decreased to be lower than the target voltage VT, the adder ADD is used to compensate for the voltage drop of the high potential power voltage VDDEL.

Figure 22:
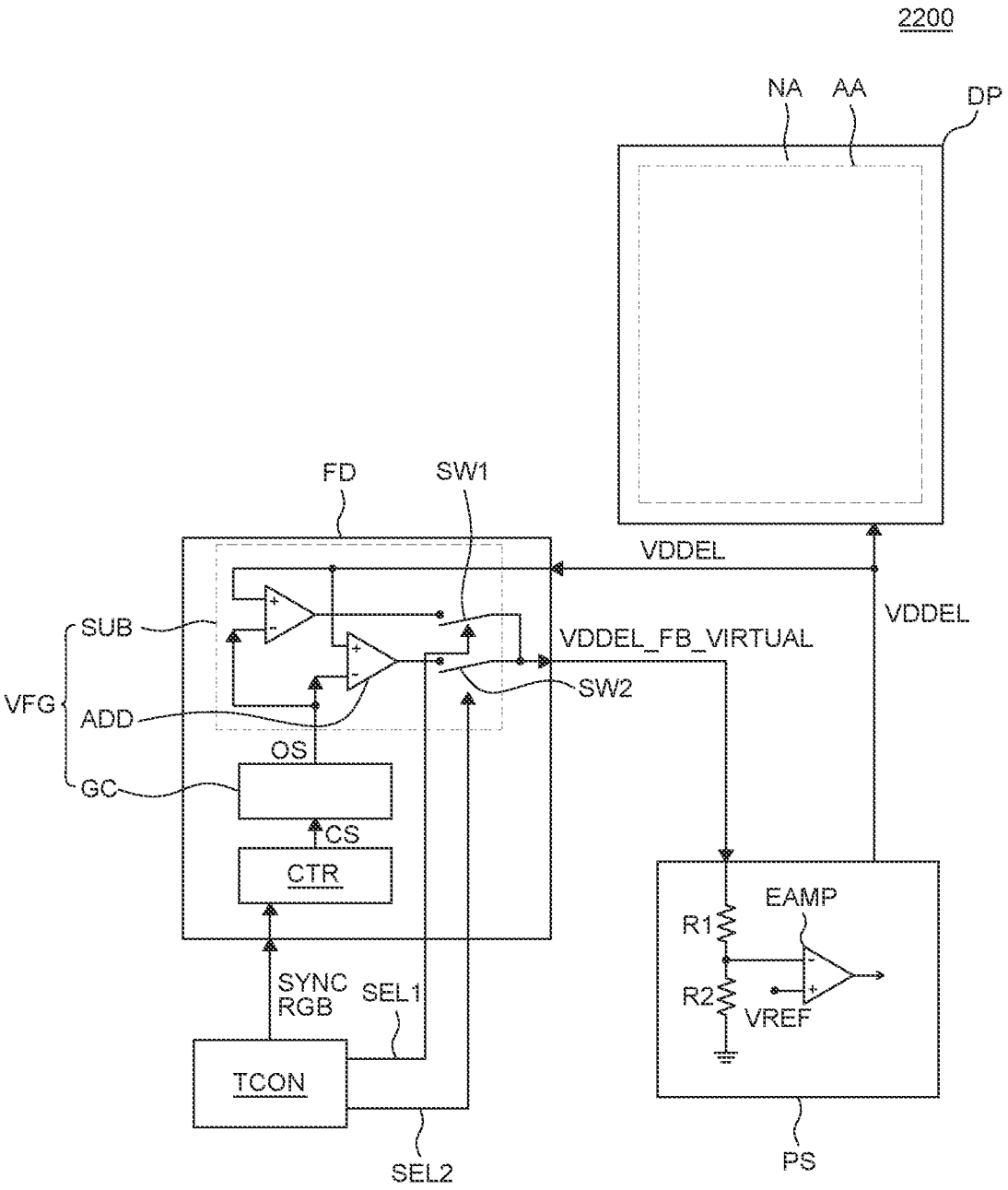
FIG. 22 is a schematic block diagram of a display device according to still another embodiment of the present disclosure.
Figure 23:
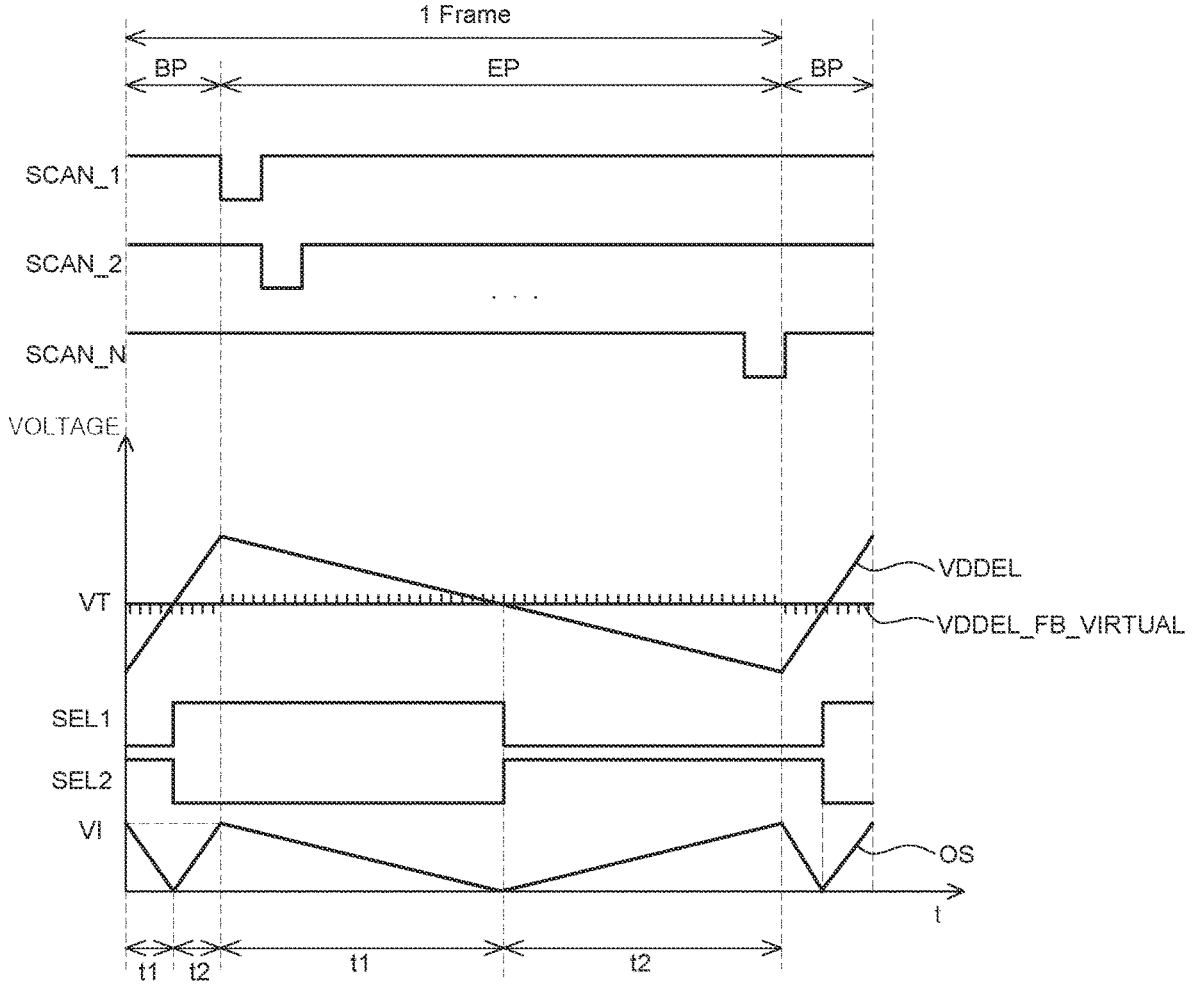
FIG. 23 is a timing diagram for explaining a virtual feedback voltage generator of a feedback part of a display device according to still another embodiment of the present disclosure.

FIG. 22 is a schematic block diagram of a display device according to still another embodiment of the present disclosure. FIG. 23 is a timing diagram for explaining a virtual feedback voltage generator of a feedback part of a display device according to still another embodiment of the present disclosure. The only difference between a display device 2200 of FIG. 22 and the display device 900 of FIG. 9 is the type of configuration for a virtual feedback voltage generator VFG but the other configuration is substantially the same, so that a redundant description will be omitted or may be briefly provided. FIG. 23 is a timing diagram when a scan signal is applied first to the uppermost sub pixel SP which is the farthest from the inlet which is a location in the display panel DP illustrated in FIG. 22, in which the high potential power voltage VDDEL is applied.

Referring to FIG. 22, the virtual feedback voltage generator VFG includes a generator circuit GC and a generator. The generator circuit GC generates an output signal OS linearly or non-linearly decreasing or increasing based on the control signal CS which is an output from the controller CTR. The generator generates a virtual feedback voltage VDDEL_FB_VIRTUAL based on the output signal OS from the generator circuit GC and the high potential power voltage VDDEL.

Here, the generator can include an adder ADD which outputs a sum of the output signal OS and the high potential power voltage VDDEL as the virtual feedback voltage VDDEL_FB_VIRTUAL and a subtractor SUB which outputs a difference between the output signal OS and the high potential power voltage VDDEL as the virtual feedback voltage VDDEL_FB_VIRTUAL. The adder ADD can be an operational amplifier and generate a virtual feedback voltage VDDEL_FB_VIRTUAL using a sum of a high potential power voltage VDDEL which is applied to a positive (+) terminal and an output signal OS which is applied to a negative terminal. The subtractor SUB can be an operational amplifier and generate a virtual feedback voltage VDDEL_FB_VIRTUAL using a difference of a high potential power voltage VDDEL which is applied to a positive (+) terminal and an output signal OS which is applied to a negative (−) terminal.

Further, the generator can include a plurality of switches SW1 and SW2 to selectively transmit an output of the subtractor SUB and an output of the adder ADD based on a plurality of selection signals SEL1 and SEL2 of the timing controller TCON. The plurality of switches SW1 and SW2 includes a first switch SW1 and a second switch SW2. The first switch SW1 can transmit the output of the subtractor SUB to the power source PS based on a first selection signal SEL1 from the timing controller TCON. The second switch SW2 can transmit the output of the adder ADD to the power source PS based on a second selection signal SEL2 from the timing controller TCON.

Referring to FIG. 23, during a first time interval t1 of the blank period BP, a turn-off signal is applied as the first selection signal SEL1 from the timing controller TCON and a turn-on signal is applied as the second selection signal SEL2. Therefore, the first switch SW1 can be turned off and the second switch SW2 can be turned on. Accordingly, during the first time interval t1 of the blank period BP, the output of the adder ADD can be transmitted to the power source as the virtual feedback voltage VDDEL_FB_VIRTUAL.

The generator circuit GC can generate an output signal OS which decreases at an initial voltage VI during the first time interval t1 of the blank period BP. In FIG. 23, the scan signal is applied first to the uppermost sub pixel SP which is a sub pixel farthest from the inlet which is a location of the display panel DP illustrated in FIG. 22 in which the high potential power voltage VDDEL is applied. Therefore, in accordance with the design of the power source PS, a voltage which is higher than a target voltage VT is applied to a sub pixel SP which is applied with a first scan signal SCAN_1 to be turned on and then the high potential power voltage VDDEL can be decreased. Therefore, the generator circuit GC can generate an output signal OS which decreases during the first time interval t1 of the blank period BP.

The generator circuit GC generates the output signal OS which decreases during the first time interval t1 of the blank period BP so that the sum of the high potential power voltage VDDEL and the output signal OS is reduced. Therefore, a sum of the high potential power voltage VDDEL which is a virtual feedback voltage VDDEL_FB_VIRTUAL generated by the adder ADD and the output signal OS can be instantaneously reduced to be lower than the target voltage VT.

Thereafter, the virtual feedback voltage VDDEL_FB_VIRTUAL instantaneously decreases. Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, the high potential power voltage VDDEL input to the adder ADD is increased so that an input value which is input to a positive (+) terminal of the operational amplifier of the adder ADD. Therefore, the sum of the high potential power voltage VDDEL and the output signal OS can be increased. By doing this, the virtual feedback voltage VDDEL_FB_VIRTUAL output from the adder ADD can also be increased. Accordingly, the virtual feedback voltage VDDEL_FB_VIRTUAL can be substantially maintained as a target voltage VT.

Referring to FIG. 23, during a second time interval t2 of the blank period BP, a turn-on signal is applied as the first selection signal SEL1 from the timing controller TCON and a turn-off signal is applied as the second selection signal SEL2. Therefore, the second switch SW2 can be turned off and the first switch SW1 can be turned on. Accordingly, during the second time interval t2 of the blank period BP, the output of the subtractor SUB can be transmitted to the power source PS as the virtual feedback voltage VDDEL_FB_VIRTUAL.

The generator circuit GC can generate an output signal OS which increases during the second time interval t2 of the blank period BP. In FIG. 23, the scan signal is applied first to the uppermost sub pixel SP which is a sub pixel farthest from the inlet which is a location of the display panel DP illustrated in FIG. 22 in which the high potential power voltage VDDEL is applied. Therefore, in accordance with the design of the power source PS, a voltage which is higher than a target voltage VT is applied to a sub pixel SP which is applied with a first scan signal SCAN_1 to be turned on and then the high potential power voltage VDDEL can be decreased. Therefore, the generator circuit GC can generate an output signal OS which increases during the second time interval t2 of the blank period BP.

The generator circuit GC generates the output signal OS which increases during the second time interval t2 of the blank period BP so that the difference between the high potential power voltage VDDEL and the output signal OS is reduced. Therefore, the high potential power voltage VDDEL which is a virtual feedback voltage VDDEL_FB_VIRTUAL generated by the subtractor SUB and the output signal OS can be instantaneously reduced to be lower than the target voltage VT.

Thereafter, the virtual feedback voltage VDDEL_FB_VIRTUAL instantaneously decreases. Therefore, the power source PS to which the virtual feedback voltage VDDEL_FB_VIRTUAL decreased to be lower than the target voltage VT is transmitted can increase the high potential power voltage VDDEL output from the power source PS to increase the virtual feedback voltage VDDEL_FB_VIRTUAL.

Thereafter, since the high potential power voltage VDDEL input to the subtractor SUB is increased so that an input value which is input to a positive (+) terminal of the operational amplifier of the subtractor SUB, the difference between the high potential power voltage VDDEL and the output signal OS can be increased. By doing this, the virtual feedback voltage VDDEL_FB_VIRTUAL output from the subtractor SUB can also be increased. Accordingly, the virtual feedback voltage VDDEL_FB_VIRTUAL can be substantially maintained as a target voltage VT.

Referring to FIG. 23 again, during a first time interval t1 of the emission period EP, a turn-on signal can be applied as the first selection signal SEL1 from the timing controller TCON and a turn-off signal can be applied as the second selection signal SEL2. Therefore, the first switch SW1 can be turned on and the second switch SW2 can be turned off. Accordingly, during the first time interval t1 of the emission period EP, the output of the subtractor SUB can be transmitted to the power source PS as the virtual feedback voltage VDDEL_FB_VIRTUAL.

Therefore, the generator circuit GC can generate an output signal OS which decreases during the first time interval t1 of the emission period EP. In FIG. 23, the scan signal is applied first to the uppermost sub pixel SP which is farthest from the inlet which is a location in the display panel DP illustrated in FIG. 22 in which the high potential power voltage VDDEL is applied. Therefore, as the time elapses to apply the first scan signal SCAN_1 and the second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the generator circuit GC can generate the output signal OS which decreases during the emission period EP.

The generator circuit GC generates the output signal OS which decreases during the emission period EP so that the difference between the high potential power voltage VDDEL and the output signal OS is increased. Therefore, the virtual feedback voltage VDDEL_FB_VIRTUAL generated by the subtractor SUB can be instantaneously increased to be higher than the target voltage VT.

Thereafter, the virtual feedback voltage VDDEL_FB_VIRTUAL instantaneously increases. Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, the high potential power voltage VDDEL input to the subtractor SUB is decreased so that an input value which is input to a positive (+) terminal of the operational amplifier of the subtractor SUB is decreased. Therefore, the difference between the high potential power voltage VDDEL and the output signal OS can be decreased. By doing this, the virtual feedback voltage VDDEL_FB_VIRTUAL output from the subtractor SUB can also be decreased. Accordingly, the virtual feedback voltage VDDEL_FB_VIRTUAL can be substantially maintained as a target voltage VT.

Referring to FIG. 23 again, during a second time interval t2 of the emission period EP, a turn-off signal can be applied as the first selection signal SEL1 from the timing controller TCON and a turn-on signal can be applied as the second selection signal SEL2. Therefore, the first switch SW1 can be turned off and the second switch SW2 can be turned on. Accordingly, during the second time interval t2 of the emission period EP, the output of the adder ADD can be transmitted to the power source PS as the virtual feedback voltage VDDEL_FB_VIRTUAL.

The generator circuit GC can generate an output signal OS which increases during the second time interval t2 of the emission period EP. In FIG. 23, the scan signal is applied first to the uppermost sub pixel SP which is farthest from the inlet which is a location in the display panel DP illustrated in FIG. 22 in which the high potential power voltage VDDEL is applied. Therefore, as the time elapses to apply a first scan signal SCAN_1 and a second scan signal SCAN_2 to an N-th scan signal SCAN N, a distance from the inlet which is a location in which the high potential power voltage VDDEL is applied to a sub pixel SP which is actually driven is gradually reduced. Therefore, in order to gradually decrease the high potential power voltage VDDEL which is applied from the power source PS during the emission period EP, the generator circuit GC can generate the output signal OS which increases during the emission period EP.

The generator circuit GC generates the output signal OS which increases during the second time interval t2 of the emission period EP so that the sum of the high potential power voltage VDDEL and the output signal OS is increased. Therefore, the virtual feedback voltage VDDEL_FB_VIRTUAL generated by the adder ADD can be instantaneously increased to be higher than the target voltage VT.

Thereafter, the virtual feedback voltage VDDEL_FB_VIRTUAL instantaneously increases (e.g., see the discrete impulses in FIG. 23). Therefore, the power source PS to which the virtual feedback voltage VDDEL_FB_VIRTUAL increased to be higher than the target voltage VT is transmitted can decrease the high potential power voltage VDDEL output from the power source PS to decrease the virtual feedback voltage VDDEL_FB_VIRTUAL.

Thereafter, the high potential power voltage VDDEL input to the adder ADD is decreased so that an input value which is input to a positive (+) terminal of the operational amplifier of the subtractor SUB. Therefore, the sum of the high potential power voltage VDDEL and the output signal OS can be reduced. By doing this, the virtual feedback voltage VDDEL_FB_VIRTUAL output from the adder ADD can also be decreased. Accordingly, the virtual feedback voltage VDDEL_FB_VIRTUAL can be substantially maintained as a target voltage VT.

In addition, even though the scan signal is applied first to the lowermost sub pixel SP which is a sub pixel SP closest to the inlet which is a location in which the high potential power voltage VDDEL is applied, the virtual feedback voltage VDDEL_FB_VIRTUAL can be supplied to the power source PS based on the description with reference to FIGS. 7 and 23.

The display device 2200 according to still another embodiment of the present disclosure can virtually perform the feedback on the high potential power voltage VDDEL without actual feedback on the high potential power voltage VDDEL in the display panel DP. That is, the display device 2200 according to still another embodiment of the present disclosure can virtually perform the feedback on the high potential power voltage VDDEL and improve the luminance imbalance and the color variation due to the voltage drop. Specifically, in the display device 2200 according to still another embodiment of the present disclosure, the adder ADD and the subtractor SUB are simultaneously used to compensate for the voltage drop of the high potential power voltage VDDEL even though a variable range of the output signal OS of the generator circuit GC is limited.

The example embodiments of the present disclosure can also be described as follows:

According to an aspect of the present disclosure, a display device includes a display panel in which a plurality of sub pixels are disposed; a power source which outputs a high potential power voltage to the display panel; and a feedback part which receives the high potential power voltage output from the power source to output a virtual feedback voltage to the power source, in which the power source changes a magnitude of the high potential power voltage in accordance with a magnitude of the virtual feedback voltage to output the high potential power voltage.

The display device can further include a timing controller which supplies a synchronization signal and image data to the feedback unit, in which the feedback part includes a controller which generates a control signal based on the synchronization signal and the image data and a virtual feedback voltage generator which generates the virtual feedback voltage based on the control signal.

The feedback part can further include a memory and the controller calls a value corresponding to the synchronization signal and the image data from the memory to generate the control signal.

The virtual feedback voltage generator can include a generator circuit which generates an output signal linearly or non-linearly decreasing or increasing, based on the control signal from the controller; and a generator which generates the virtual feedback voltage based on the output signal from the generator circuit and the high potential power voltage.

The generator can include a transistor including a gate electrode to which the output signal is applied, a drain electrode to which the high potential power voltage is applied, and a source electrode which outputs the virtual feedback voltage.

The transistor can operate as a source follower to output the virtual feedback voltage to be high when the output signal is increased and output the virtual feedback voltage to be high when the high potential power voltage is increased.

The transistor can be disposed on the display panel. The generator can include a subtractor which outputs a difference between the output signal and the high potential power voltage as the virtual feedback voltage. The subtractor can be an operational amplifier.

The generator can include an adder which outputs a sum of the output signal and the high potential power voltage as the virtual feedback voltage.

The generator can include a subtractor which outputs a difference between the output signal and the high potential power voltage as the virtual feedback voltage; an adder which outputs a sum of the output signal and the high potential power voltage as the virtual feedback voltage; and a plurality of switches which selectively transmits an output of the subtractor and an output of the adder based on a plurality of selection signals of the timing controller.

The plurality of sub pixels can be driven in a unit of a frame including a blank period and an emission period, and the generator circuit can generate the output signal which increases during the blank period and can decrease during the emission period or the output signal which decreases during the blank period and increases during the emission period.

The power source can include an error amplifier which amplifies a difference between the virtual feedback voltage and a reference voltage.

When the magnitude of the virtual feedback voltage can be larger than a threshold value, the power source can decrease the high potential power voltage to be output and when the magnitude of the virtual feedback voltage can be smaller than the threshold value, the power source can increase the high potential power voltage to be output.

The power source can include a sensor which senses a current value which is output to an output terminal of the power source based on an output of the error amplifier; a power look-up table which stores a resistance between the output terminal of the power source and the display panel; a power multiplier which multiplies the current value and the resistance; and a reference voltage source which adjusts a magnitude of the reference voltage based on an output of the power multiplier.

The feedback part can be disposed separately from the timing controller, the display panel, and the power source.

Each of the controller and the virtual feedback voltage generator can be integrated with at least one of the timing controller, the display panel, and the power source.

The controller can include a voltage drop amount calculator which calculates a voltage drop amount of the high potential power voltage generated between an output terminal of the power source and the display panel from the image data; a variation calculator which calculates a variation of the output signal from the generator circuit which linearly or non-linearly decreases or increases from the image data; and an adder which adds the voltage drop amount and the variation to generate the control signal.

The voltage drop amount calculator can include a first look-up table in which a current amount corresponding to the image data flowing from the output terminal of the power source to the display panel is stored; a second look-up table which stores a resistance between the output terminal of the power source and the display panel; and a multiplier which calculates the voltage drop amount by multiplying an output from the first look-up table and an output from the second look-up table.

The virtual feedback voltage generator can include a digital analog converter which generates an output signal for every 1 horizontal period based on the control signal from the controller; and a subtractor which outputs a difference between the output signal from the digital analog converter and the high potential power voltage as the virtual feedback voltage.

The virtual feedback voltage generator can include a digital analog converter which generates a first output signal at each of the plurality of horizontal periods based on the control signal from the controller; a generator circuit which generates a second output signal which linearly or non-linearly decreases or increases based on the first output signal from the digital analog converter; and a generator which outputs a difference between the second output signal from the generator circuit and the high potential power voltage as the virtual feedback voltage.

The feedback part can generate the virtual feedback voltage based on an external input.

Although the example embodiments of the present disclosure have been described in detail with reference to the accompanying drawings, the present disclosure is not limited thereto and can be embodied in many different forms without departing from the technical concept of the present disclosure. Therefore, the example embodiments of the present disclosure are provided for illustrative purposes only but not intended to limit the technical concept of the present disclosure. The scope of the technical concept of the present disclosure is not limited thereto. Therefore, it should be understood that the above-described example embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display panel including a plurality of subpixels;

a feedback part;

a power source configured to output a first power voltage to the feedback part and the display panel; and a timing controller configured to supply a synchronization signal to the feedback part, and supply image data to the feedback part, wherein the feedback part is configured to output a virtual feedback voltage to the power source, the virtual feedback voltage being based on the first power voltage, wherein the feedback part is further configured to output the virtual feedback voltage based on at least one of the image data and the synchronization signal, and wherein the power source is further configured to adjust a magnitude of the first power voltage to generate an adjusted first power voltage based on the virtual feedback voltage.

2. The display device according to claim 1, further comprising:

a memory configured to store one or more values, wherein the feedback part is further configured to:

receive a value from the memory, the value being based on the at least one of the synchronization signal and the image data, and output virtual feedback voltage based on the value.

3. The display device according to claim 1, wherein the feedback part includes:

a controller configured to generate a control signal based on the image data and the synchronization signal; and a virtual feedback voltage generator configured to generate the virtual feedback signal based on the control signal, wherein the virtual feedback voltage generator includes:

a generator circuit configured to generate an output signal that increases or decreases based on the control signal from the controller; and a generator configured to generate the virtual feedback voltage based on both of the output signal from the generator circuit and the first power voltage.

4. The display device according to claim 3, wherein the generator includes:

a transistor including a gate electrode configured to receive the output signal;

a drain electrode configured to receive the first power voltage; and a source electrode configured to output the virtual feedback voltage.

5. The display device according to claim 4, wherein the transistor is configured to operate as a source follower to increase the virtual feedback voltage when the output signal is increased and increase the virtual feedback voltage when the first power voltage is increased.

6. The display device according to claim 4, wherein the transistor is disposed in the display panel.

7. The display device according to claim 3, wherein the generator includes:

a subtractor configured to output a difference between the output signal and the first power voltage, and wherein the feedback part is further configured to output the virtual feedback voltage based on the difference.

8. The display device according to claim 7, wherein the subtractor is an operational amplifier.

9. The display device according to claim 3, wherein the generator includes:

an adder configured to output a sum of the output signal and the first power voltage, and wherein the feedback part is further configured to output the virtual feedback voltage based on the sum.

10. The display device according to claim 3, wherein the generator includes:

a subtractor configured to output a difference between the output signal and the first power voltage;

an adder configured to output a sum of the output signal and the first power voltage; and a plurality of switches configured to selectively transmit an output of the subtractor or an output of the adder based on one or more selection signals received from the timing controller, and wherein the feedback part is further configured to output the virtual feedback voltage based on the difference from the subtractor or the sum from the adder.

11. The display device according to claim 3, wherein the timing controller is configured to drive the plurality of subpixels in a frame period including a blank period and an emission period, and wherein the generator circuit is further configured to:

increase the output signal during the blank period and decrease the output signal during the emission period, or decrease the output signal during the blank period and increase the output signal during the emission period.

12. The display device according to claim 3, wherein the power source includes an error amplifier configured to amplify a difference between the virtual feedback voltage and a reference voltage.

13. The display device according to claim 12, wherein when a magnitude of the virtual feedback voltage is larger than a threshold value, the power source decreases a voltage level of the first power voltage, and when the magnitude of the virtual feedback voltage is less than the threshold value, the power source increases the voltage level of the first power voltage.

14. The display device according to claim 12, wherein the power source includes:

a sensor configured to sense a current value output to an output terminal of the power source based on an output of the error amplifier;

a power look-up table configured to store a resistance value between the output terminal of the power source and the display panel;

a power multiplier configured to multiply the current value and the resistance; and a reference voltage source configured to adjust a magnitude of the reference voltage based on an output of the power multiplier.

15. The display device according to claim 3, wherein the feedback part is disposed separately from the timing controller, the display panel, and the power source.

16. The display device according to claim 3, wherein each of the controller and the virtual feedback voltage generator is integrated with at least one of the timing controller, the display panel, or the power source.

17. The display device according to claim 3, wherein the controller includes:

a voltage drop amount calculator configured to calculate a voltage drop amount of the first power voltage generated between an output terminal of the power source and the display panel based on the image data;

a variation calculator configured to calculate a variation of the output signal from the generator circuit; and an adder configured to generate the control signal based on a sum of the voltage drop amount and the variation.

18. The display device according to claim 17, wherein the voltage drop amount calculator includes:

a first look-up table storing one or more current amounts associated with one or more image data, the one or more current amounts corresponding to current flowing from the output terminal of the power source to the display panel;

a second look-up table storing one or more resistance values for a resistance between the output terminal of the power source and the display panel, the resistance being configured to change based which subpixel among the plurality of subpixels is currently in a powered on state; and a multiplier configured to calculate the voltage drop amount by multiplying an output from the first look-up table and an output from the second look-up table.

19. The display device according to claim 1, wherein the feedback part includes:

a controller configured to generate a control signal based on the image data and the synchronization signal; and a virtual feedback voltage generator configured to generate the virtual feedback signal based on the control signal, wherein the virtual feedback voltage generator includes:

a digital analog converter configured to generate an output signal for every 1 horizontal period based on the control signal from the controller; and a subtractor configured to output the virtual feedback voltage based on a difference between the output signal from the digital analog converter and the first power voltage.

20. The display device according to claim 1, wherein the feedback part includes:

a controller configured to generate a control signal based on the image data and the synchronization signal; and a virtual feedback voltage generator configured to generate the virtual feedback signal based on the control signal, wherein the virtual feedback voltage generator includes:

a digital analog converter configured to generate a first output signal at each of the plurality of horizontal periods based on the control signal from the controller;

a generator circuit configured to generate a second output signal that decreases or increases based on the first output signal from the digital analog converter; and a generator configured to output a difference between the second output signal from the generator circuit and the first power voltage as the virtual feedback voltage.

21. The display device according to claim 1, wherein the feedback part generates the virtual feedback voltage based on an external input.

22. A display device, comprising:

a display panel including a plurality of subpixels;

a feedback part;

a power source configured to output a first power voltage to the feedback part and the display panel; and a timing controller configured to supply a synchronization signal to the feedback part, and supply image data to the feedback part, wherein the feedback part is configured to:

receive the first power voltage directly from the power source without any voltage drop due to the display panel, output a virtual feedback voltage to the power source, the virtual feedback voltage being based on the first power voltage and at least one of the image data and the synchronization signal, and wherein the power source is further configured to adjust a magnitude of the first power voltage to generate an adjusted first power voltage based on the virtual feedback voltage.

23. A feedback device for controlling a power source of a display device, the feedback device comprising:

a feedback part configured to:

receive a first power voltage directly from a power source without any voltage drop due to a display panel, receive a synchronization signal and image data from a timing controller, and output a virtual feedback voltage to the power source for adjusting the first power voltage output by the power source, the virtual feedback voltage being based on the first power voltage and at least one of the image data and the synchronization signal.

* * * * *